US010969713B2

(12) United States Patent
Aiba et al.

(10) Patent No.: US 10,969,713 B2
(45) Date of Patent: Apr. 6, 2021

(54) IMAGE HEATING APPARATUS THAT CONTROLS PLURAL HEAT GENERATING BLOCKS BASED ON WHETHER A RECORDING MATERIAL PASSES THE RESPECTIVE BLOCK, AND IMAGE FORMING APPARATUS

(71) Applicant: CANON KABUSHIKI KAISHA, Tokyo (JP)

(72) Inventors: Hirohiko Aiba, Suntou-gun (JP); Tomonori Sato, Hamamatsu (JP); Hideaki Yonekubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/853,919

(22) Filed: Apr. 21, 2020

(65) Prior Publication Data

US 2020/0341416 A1 Oct. 29, 2020

(30) Foreign Application Priority Data

Apr. 24, 2019 (JP) ..... JP2019-083097

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2046
USPC ..... 399/69
See application file for complete search history.

(56) References Cited

U.S. PATENT DOCUMENTS 10,429,781 B2 * 10/2019 Shimura et al. ... G03G 15/2039
10,459,379 B2 10/2019 Shimura
10,620,572 B2 * 4/2020 Miyauchi et al. ..... G03G 15/2039
10,656,573 B2 5/2020 Aiba
2020/0174409 A1 * 6/2020 Kataoka et al. ... G03G 15/2046

FOREIGN PATENT DOCUMENTS

JP 2014-059508 A 4/2014

OTHER PUBLICATIONS

Co-pending, unpublished U.S. Appl. No. 16/830,355, filed Mar. 26, 2020.

* cited by examiner

*Primary Examiner* — William J Royer
(74) *Attorney, Agent, or Firm* — Venable LLP

(57) ABSTRACT

A controller controls power to be supplied to a plurality of heat-generating blocks obtained by dividing a heater in a direction orthogonal to a transport direction for a recording material, and when images formed on a plurality of sheets of the recording material having an equal size are continuously heated, and the controller determines whether each of the heat-generating blocks is a heat-generating block which is passed by the recording material or a heat-generating block which is not passed by the recording material on the basis of a detection temperature by a temperature detecting element when prescribed power is supplied to the heat-generating block and changes a control condition in heating on the basis of the determination.

12 Claims, 18 Drawing Sheets

IMAGE HEATING APPARATUS THAT CONTROLS PLURAL HEAT GENERATING BLOCKS BASED ON WHETHER A RECORDING MATERIAL PASSES THE RESPECTIVE BLOCK, AND IMAGE FORMING APPARATUS

BACKGROUND OF THE INVENTION

Field of the Invention

The present invention relates to a fixing apparatus provided in an electrophotographic image forming apparatus such as a copier and a printer or to an image heating apparatus such as a gloss providing device which increases the gloss value of a toner image by re-heating a toner image fixed on a recording material. The present invention also relates to a heater used in the image heating apparatus.

Description of the Related Art

There is an image heating apparatus which includes a tubular film, a heater in contact with the inner surface of the film, and a roller which forms a nip portion with the heater through the film. When a small size sheet is continuously printed by the image forming apparatus provided with the image heating apparatus, the temperature in the region which is not passed by a paper sheet in the longitudinal direction of the nip portion gradually increases (or a non-sheet-passing-part temperature increase occurs).

As an image heating apparatus, it is necessary to ensure that the temperature of the non-sheet-passing part does not exceed the heat resistance temperature of each of the members of the apparatus. In an apparatus according to one proposed approach for controlling the temperature increase at the non-sheet-passing-part, a heat generating resistor on a heater is divided into a plurality of groups (heat-generating blocks) in the longitudinal direction of the heater and the heating distribution of the heater is switched according to the size of the recording material (Japanese Patent Application Publication No. 2014-59508). A sensing member, such as a thermistor, for detecting the temperature of a heat-generating block is provided at each of a plurality of heat-generating blocks, and the amount of generated heat is controlled on the basis of the detection result.

In the above-described apparatus, the temperature of the part passed by the recording material is controlled at the temperature necessary for fixing the toner image. The non-sheet-passing part which is not passed by the recording material is not deprived of heat by the recording material, and the members in the part easily store the heat, and therefore, the heat value is smaller than that of the part passed by the recording material.

SUMMARY OF THE INVENTION

A heater is normally designed so that the width of a heat-generating block and the width of a regular type recording material match and a non-sheet-passing part temperature increase is not generated. For example, as shown in FIG. 1, the width of a B5 size sheet is matched to the width of heat-generating blocks HB3 to HB5, and the temperature of the heat-generating blocks HB3 to HB5 is set to a temperature necessary for fixing a toner image while heat-generating blocks HB1, HB2, HB6, and HB7 are set to the lower limit temperature for the film to rotate.

However, as shown in FIG. 2A, when the user sets and passed a recording material in a position shifted from the normal position, the non-sheet-passing part temperature increase can be generated in the part of the heat-generating block HB6 which is not passed by the recording material. As a result, the roller may thermally expand at the part with the temperature increase, which may cause instability during transport of the recording material.

As shown in FIG. 2B, when the size of the recording material specified by the user and the size of the actually passed sheet are different, the heat-generating blocks HB2 and HB6 are controlled at high temperature considering the recording material passes these blocks, while the recording material does not actually pass, and excess heat is stored by the members. This may cause a damage to the image heating apparatus.

It is an object of the present invention to prevent excessive a non-sheet-passing part temperature increase and heat storage, stabilize transport of a recording material, and prevent damages to the image forming apparatus by estimating a longitudinal position in which a sheet of the recording material is actually passed and controlling each of the heat-generating blocks at an optimum temperature on the basis of the estimation result.

In order to achieve the above-described object, an image heating apparatus according to the present invention includes:

a heating unit which includes a heater for heating an image formed on a recording material and has a plurality of divided heat-generating blocks in a direction orthogonal to a transport direction for a recording material;

a temperature detecting element which detects a temperature of each of the heat-generating blocks; and a controller which controls power to be supplied to each of the heat-generating blocks, wherein, when the image heating apparatus continuously heats images formed on a plurality of sheets of the recording material having an equal size, the controller determines whether each of the heat-generating blocks is a heat-generating block which is passed by the recording material or a heat-generating block which is not passed by the recording material on the basis of a detection temperature by the temperature detecting element when the heat-generating block is supplied with prescribed power, and changes a control condition in the heating on the basis of the determination.

In order to achieve the above-described object, an image heating apparatus according to the present invention includes:

a heating unit which includes a heater for heating an image formed on a recording material and has a plurality of divided heat-generating blocks in a direction orthogonal to a transport direction for a recording material;

a temperature detecting element which detects a temperature of each of the heat-generating blocks; and a controller which controls power to be supplied to each of the heat-generating blocks, wherein, when the image heating apparatus continuously heats images formed on a plurality of sheets of the recording material having an equal size, the controller determines whether each of the heat-generating blocks is a heat-generating block which is passed by the recording material or a heat-generating block which is not passed by the recording material on the basis of the level of the power supplied to the heat-generating block when the power to be supplied to the heat-generating block is controlled such that the detection temperature by the temperature detecting element is maintained at a prescribed control target temperature, and changes a control condition in the heating on the basis of the determination.

In order to achieve the above-described object, an image forming apparatus according to the present invention includes:

an image forming portion which forms an image on a recording material;

a fixing portion which fixes the image formed on the recording material, on the recording material; and a controller, the fixing portion including:

a heating unit which includes a heater for heating an image formed on the recording material and has a plurality of divided heat-generating blocks in a direction orthogonal to a transport direction for a recording material; and a temperature detecting element which detects a temperature of each of the heat-generating blocks, wherein the controller controls power to be supplied to each of the heat-generating blocks, wherein, when the fixing portion continuously heats images formed on a plurality of sheets of the recording material having an equal size, the controller determines whether each of the heat-generating blocks is a heat-generating block which is passed by the recording material or a heat-generating block which is not passed by the recording material on the basis of the level of power supplied to each of the heat-generating block when the power supplied to each of the heat-generating block is controlled such that the detection temperature by the temperature detecting element is maintained at a prescribed control target temperature, and changes a control condition in the heating on the basis of the determination.

According to the present invention, excessive temperature rise at a non-sheet-passing-part or heat storage can be prevented, a recording material can be transported stably, and damages to the image heating apparatus can be prevented.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 3:
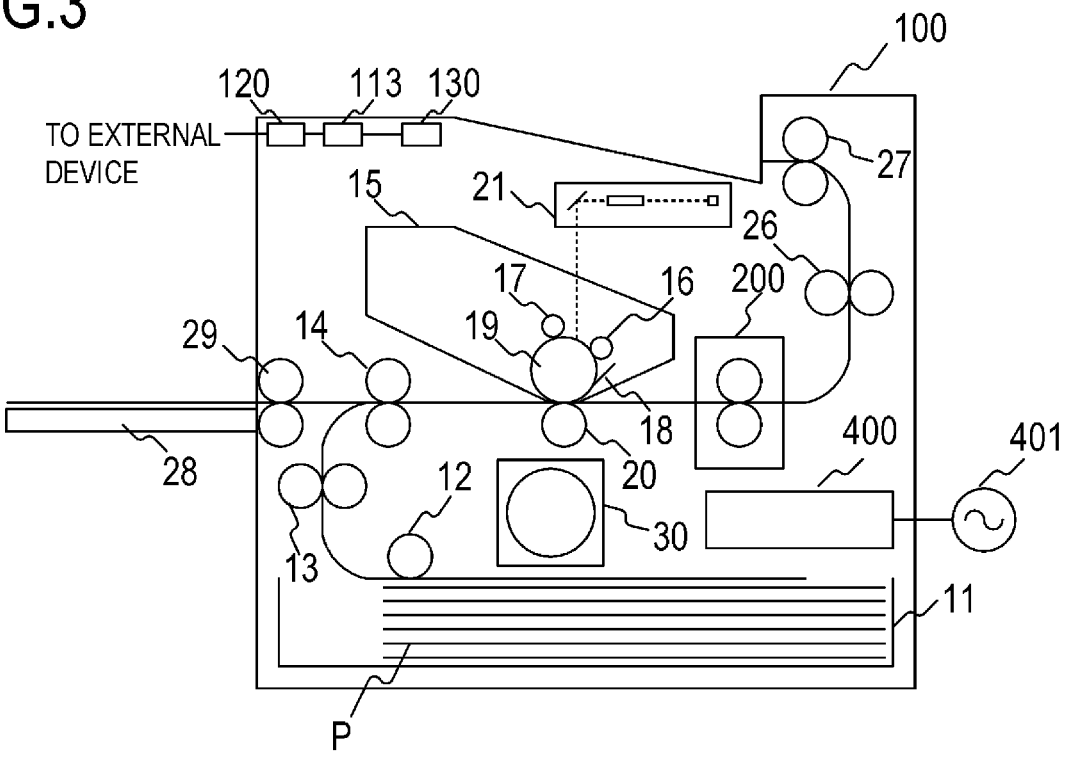
FIG. 3 is a sectional view of an image forming apparatus.

FIG. 3 is a schematic sectional view of an image forming apparatus 100 according to an embodiment of the present invention. An image forming apparatus to which the present invention is applicable may include an electrophotographic or electrostatic recording type copier or printer, and herein an image forming apparatus which forms an image on a recording material P according to an electrophotographic system will be described.

The image forming apparatus 100 includes a video controller 120 and a controller 113. The video controller 120 serves as an obtaining portion which obtains information such as information on an image to be formed on a recording material and on the size and type of the recording material on which an image is to be formed, and receives and processes the image information and a print instruction transmitted from an external device such as a personal computer. The image forming apparatus 100 also includes an operation panel 130, and various kinds of information and print instructions may be transmitted to the controller 113 by input from the operation panel 130 by a user. The controller 113 is connected to the video controller 120 and controls each component of the image forming apparatus 100 in response to an instruction from the video controller 120. Upon receiving a print instruction from an external device, the video controller 120 forms an image by the following operation.

When a print signal is generated, a scanner unit 21 emits a laser beam modulated according to the image information and scans a photosensitive member (photosensitive drum) 19 charged to a predetermined polarity by a charging roller 16. As a result, an electrostatic latent image is formed on the photosensitive member 19. Toner is supplied onto the electrostatic latent image from a developer (developing roller) 17, and a toner image corresponding to the image information is formed on the photosensitive member 19. Meanwhile, sheets of the recording material (recording sheets) P stacked on a sheet feed cassette 11 are fed one by one by a pick-up roller 12 and are transported to a pair of resist rollers 14 by a pair of transport rollers 13. The recording material P is then transported from the pair of resist rollers 14 to a transfer position in the timing in which the toner image on the photosensitive member 19 reaches the transfer position formed by the photosensitive member 19 and a transfer roller 20. In the process in which the recording material P passes the transfer position, the toner image on the photosensitive member 19 is transferred to the recording material P. Thereafter, the recording material P is heated by a fixing apparatus (image heating apparatus) 200 as a fixing portion (image heating portion) and the toner image is heated and fixed on the recording material P. The recording material P carrying the fixed toner image is discharged to a tray at the upper part of the image forming apparatus 100 by a pair of transport rollers 26 and 27.

A drum cleaner 18 cleans toner remaining at the photosensitive drum 19. A sheet feed tray 28 (manual tray) having a pair of recording material control plates which can be adjusted in width according to the size of the recording material P is also provided to accommodate a recording material P in a size other than the regular size. A pick-up roller 29 feeds the recording material P from the sheet feed tray 28. The image forming apparatus 100 includes a motor 30 which drives for example the fixing apparatus 200. A control circuit 400 as a heater drive unit connected to a commercially available AC power supply 401 controls power supply to the fixing apparatus 200.

The photosensitive drum 19, the charging roller 16, the scanner unit 21, the developing roller 17, and the transfer roller 20 described above constitute the image forming portion which forms an unfixed image on the recording material P. According to the embodiment, the photosensitive drum 19, the charging roller 16, a developing unit including the developing roller 17, and a cleaning unit including the drum cleaner 18 are configured as a process cartridge 15 in a detachable manner to the body of the image forming apparatus 100.

The image forming apparatus 100 according to the embodiment can cope with a plurality of recording material sizes. For example, a Letter size sheet (about 216 mm×279 mm), an A4 size sheet (210 mm×297 mm), a B5 size sheet (about 182 mm×257 mm), or an A5 size sheet (148 mm×210 mm) can be set at the sheet feed cassette 11.

The image forming apparatus 100 according to the embodiment is a laser printer which basically feeds the sheet in the longitudinal direction (so that the long sides of the sheet are in parallel with the transport direction). The present invention can also be applied to a printer which feeds sheets in the transverse direction. The largest recording material having the largest width among the widths (widths of recording materials in a catalog) of the regular recording materials which can be accommodated by the apparatus is the Letter size sheet having a width of about 216 mm.

Figure 4:
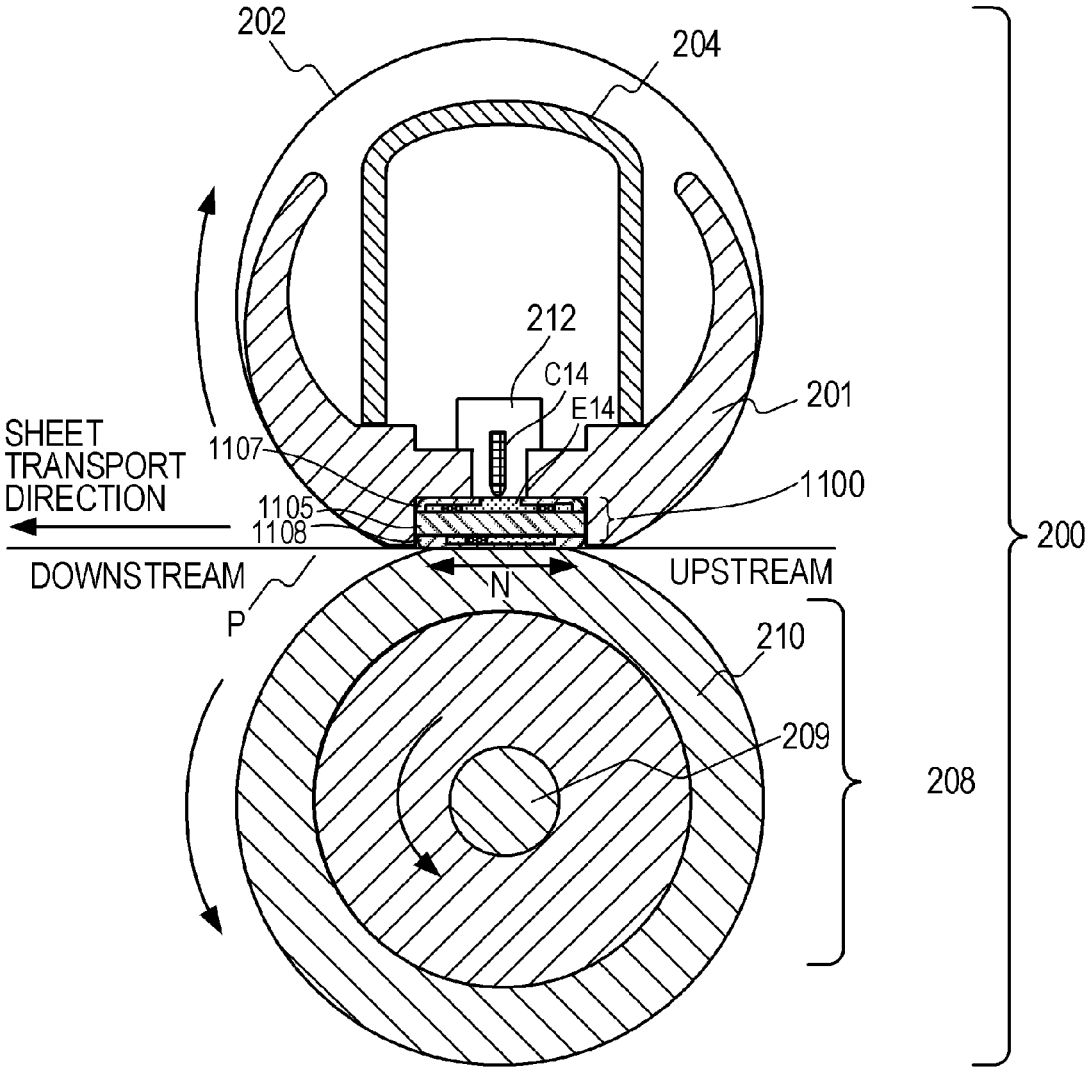
FIG. 4 is a sectional view of a heat generating apparatus.

FIG. 4 is a schematic sectional view of the fixing apparatus 200 as an image heating apparatus according to the embodiment. The fixing apparatus 200 includes a tubular film 202 as a heating rotating member, a heater 1100, and a pressure roller (pressurizing rotating member) 208 in contact with the outer surface of the film 202. The pressure roller 208 forms a fixing nip portion N together with the heater 1100 through the film 202.

The film 202 is a flexible, tubular multi-layer heat-resistant film, and the material of the base layer of the film is a heat resistant resin such as polyimide or a metal such as stainless steel. The film 202 may also be provided with an elastic layer made of heat-resistant rubber or a mold-release layer made of a heat-resistant resin.

The pressure roller 208 includes a core bar 209 of a material such as iron or aluminum and an elastic layer 210 of a material such as silicone rubber. The heater 1100 is held at a holding member 201 of a heat resistant resin such as liquid crystal polymer. The holding member 201 also functions as a guide which guides the film 202 to rotate. The heating unit 220 includes the heater 1100, the holding member 201, and a metal stay 204 which will be described, and is configured to be in contact with the inner surface of the film 202.

The sliding part between the film 202 and the heater 1100 and the holding member 201 is coated with viscous grease which is not shown. The grease is a mixture of fluororesin and fluorine oil and serves to lower the sliding resistance between the film 202 and the heater 1100 and the holding member 201. The viscosity of the grease is correlated with the temperature, and as the temperature rises, the viscosity is lowered and the slidability is improved. The pressure roller 208 receives motive power from the motor 30 and rotates in the direction indicated by the arrow. As the pressure roller 208 rotates, the film 202 is driven to rotate. The recording material P carrying an unfixed toner image is sandwiched and transported by the fixing nip portion N and heated to be fixed. As described above, the fixing apparatus 200 includes the tubular film 202 and the heater 1100 and heats an image formed on the recording material P by the heat of the heater 1100 through the film 202.

The heater 1100 has a ceramic substrate 1105 and a heat generating resistor (heating element) (see FIGS. 5A to 5C) provided on the substrate 1105 to generate heat as power is supplied thereto. A surface (first surface) of the substrate 1105 on the side of the fixing nip portion N is provided with a glass surface protection layer 1108 to ensure the slidability of the film 202. A glass surface protection layer 1107 is provided on a surface (second surface) opposite to the surface of the substrate 1105 on the side of the fixing nip portion N to insulate the heat generating resistor. An electrode (designated by E14 as a typical example here) is exposed at the second surface, and the heat generating resistor is electrically connected to the AC power supply 401 as the power supply electrical contact (designated by C14 as a typical example here) contacts the electrode. The heater 1100 will be described later in detail.

A protective element 212 such as a thermo switch and a temperature fuse which operates in response to abnormal heat generation by the heater 1100 to shut off the power supplied to the heater 1100 is provided in contact with the heater 1100 or with a small gap between the heater 1100 and itself. A metal stay 204 is provided to apply a spring pressure (not shown) to the holding member 201 and also serves to reinforce the holding member 201 and the heater 1100.

Figure 5A:
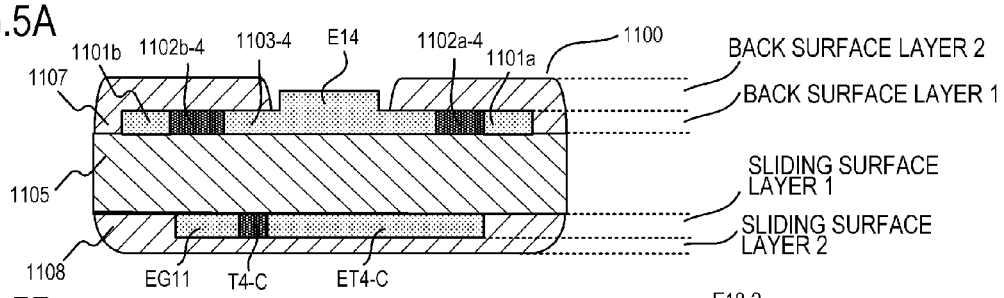
FIGS. 5A to 5C are views of the structure of a heater.
Figure 5B:
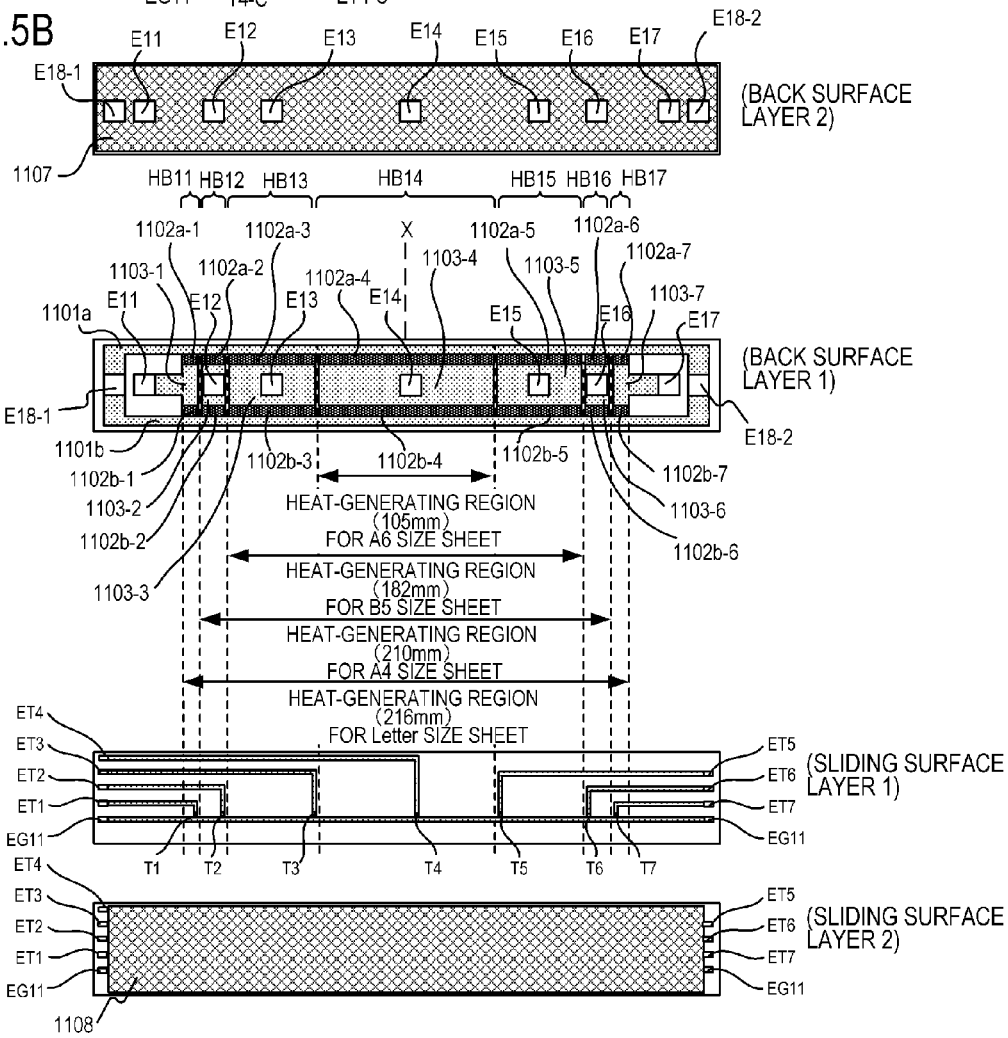
Figure 5C:
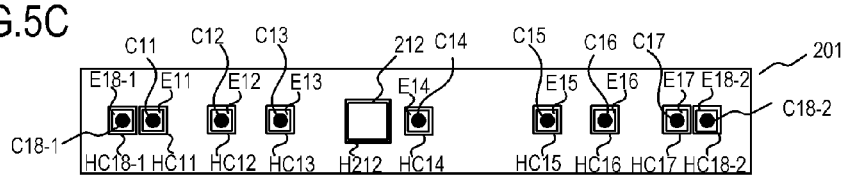

FIGS. 5A and 5B are views of the heater 1100 according to the first embodiment. FIG. 5A is a sectional view of the heater 1100 in the vicinity of a transport reference position X of the recording material P shown in FIG. 5B. FIG. 5B is a plan view showing the layers of the heater 1100. FIG. 5C is a plan view of the holding member 201 which holds the heater 1100.

The image forming apparatus 100 according to the embodiment is a center reference printer which transports a recording material having its center in the widthwise direction (the direction perpendicular to the transport direction) aligned with the transport reference position X.

The heater 1100 includes the ceramic substrate 1105, a back surface layer 1 provided on the substrate 1105, a back surface layer 2 which covers the back surface layer 1, a sliding surface layer 1 provided on a surface opposite to the back surface layer 1 on the substrate 1105, and a sliding surface layer 2 which covers the sliding surface layer 1.

At the back surface layer 1 of the heater 1100 as a heater surface opposite to the heater surface in contact with the film 202, a plurality of heat-generating blocks each including a set of a first conductor 1101, a second conductor 1103, and a heat generating resistor (heating element) 1102 are provided in the longitudinal direction of the heater 1100. The heater 1100 according to the embodiment has seven heat-generating blocks HB11 to HB17 in total. Independent control of the heat-generating blocks will be discussed later.

The heat-generating blocks each have the first conductor 1101 provided in the longitudinal direction of the substrate 1105 and the second conductor 1103 provided in the longitudinal direction of the substrate 1105 in a different position from the first conductor 1101 in the transverse direction (the direction perpendicular to the longitudinal direction) of the substrate 1105. The heat generating resistor 1102 is provided between the first conductor 1101 and the second conductor 1103 to generate heat by power supplied through the first conductor 1101 and the second conductor 1103.

The heat generating resistor 1102 of the heat-generating block are divided into heat generating resistors 1102*a* and 1102*b* formed in a symmetric position with reference to the center of the substrate 1105 in the transverse direction of the heater 1100. The first conductor 1101 is divided into a conductor 1101*a* connected to the heat generating resistor 1102*a* and a conductor 1101*b* connected to the heat generating resistor 1102*b*. The heat generating resistor 1102*a* and the heat generating resistor 1102*b* are formed in a symmetric position with respect to the center of the substrate 1105.

Since the heater 1100 has the seven heat-generating blocks HB11 to HB17, the heat generating resistor 1102*a* is divided into seven parts, 1102*a*-1 to 1102*a*-7. Similarly, the heat generating resistor 1102*b* is divided into seven parts, 1102*b*-1 to 1102*b*-7. The second conductor 1103 is divided into seven parts, 1103-1 to 1103-7. Note that the heat generating resistors 1102*a*-1 to 1102*a*-7 are provided upstream of the recording material P in the substrate 1105 in the transport direction, and the heat generating resistors 1102*b*-1 to 1102*b*-7 are provided downstream of the recording material P in the substrate 1105 in the transport direction.

The back surface layer 2 of the heater 1100 is provided with the surface protection layer 1107 of an insulating material (glass according to the embodiment) which covers the heat generating resistor 1102, the first conductor 1101, and the second conductor 1103. However, the surface protection layer 1107 does not cover electrodes E11 to E17, E18-1, and E18-2 contacted by electrical contacts C11 to C17, C18-1, and C18-2 for supplying power. Electrodes E11 to E17 are electrodes which supply power to the heat-generating blocks HB11 to HB17 through the second conductors 1103-1 to 1103-7, respectively. The electrodes E18-1 and E18-2 are electrodes which supply power to the heat-generating blocks HB11 to HB17 through the first conductors 1101*a* and 1101*b*.

The resistance values of the conductors, which are not zero, affect the distribution of generated heat in the longitudinal direction of the heater 1100. Therefore, the electrodes E18-1 and E18-2 are apart from each other at the longitudinal ends of heater 1100 so that the heat distribution does not become uneven when being affected by the electrical resistance of the first conductors 1101*a* and 1101*b* and the second conductors 1103-1 to 1103-7.

As shown in FIG. 4, protective element 212, the electrical contacts C11 to C17, C18-1, and C18-2 are provided in the space between the stay 204 and the holding member 201. As shown in FIG. 5C, the holding member 201 is provided with holes HC11 to HC17, HC18-1, and HC18-2 through which the electrical contacts C11 to C17, C18-1, and C18-2 connected to the electrodes E11 to E17, E18-1, and E18-2 are passed. The holding member 201 also includes a hole H212 through which the heat-sensitive portion of the protective element 212 is passed. The electrical contacts C11 to C17, C18-1, and C18-2 are electrically connected to corresponding electrodes for example by a method such as spring biasing or welding. The protective element 212 is also biased by a spring, and its heat sensitive portion contacts the surface protection layer 1107. Each of the electrical contacts is connected to the control circuit for the heater 1100 through a conductive member such as a cable and a thin metal plate provided in the space between stay 204 and the holding member 201.

The electrodes are provided on the back surface of the heater 1100, so that the transverse width of the substrate 1105 can be reduced because there is no need to provide a region on the substrate 1105 for wiring to establish electrical connection to each of the second conductors 1103-1 to 1103-7. Therefore, the size of the heater 1100 can be prevented from increasing. As shown in FIG. 5B, the electrodes E12 to E16 are provided in the region of the substrate 1105 where the heat generating resistor is provided in the longitudinal direction.

As will be described, the heater 1100 according to the embodiment can form various heating distributions by independently controlling the plurality of heat-generating blocks. For example, a heat distribution can be set according to the size of a recording material. The heat generating resistor 1102 is made of a material having a positive temperature coefficient (PTC). Using the material having a PTC, the non-sheet-passing part can be prevented from increasing in temperature even when the end of the recording material and the boundary of the heat-generating blocks do not match.

The sliding surface layer 1 of the heater 1100 on the side of the sliding surface (the surface on the side in contact with the film) is provided with thermistors (temperature sensing elements) T1 to T7 for detecting the temperature of the heat-generating blocks HB11 to HB17, respectively. The material of the thermistors may be a material with a large positive or negative temperature coefficient of resistance (TCR). In this example, a material having a negative temperature coefficient (NTC) is printed thin on a substrate to form a thermistor as a temperature sensing unit. Using these thermistors, the film is controlled to attain a target temperature.

The arrangement of the thermistors for the heat-generating blocks will be described.

As shown in FIG. 5B, one thermistor is arranged for one heat-generating block. For example, the thermistor T5 is provided at the heat-generating block HB15, and a conductive pattern ET5 for detecting a resistance value and a common conductive pattern EG11 are configured to detect a temperature.

In the configuration according to the embodiment, the thermistors for the heat-generating blocks are each provided at the end near the sheet passing reference so that the thermistors can be within the range of the sheet-passing region if the width of the recording material is changed. The longitudinal positions of the thermistors are not limited to those according to the embodiment. For example, a thermistor may be arranged in the longitudinal center of each of heat-generating blocks.

In order to ensure the slidability of the film 202 on the surface (sliding surface layer 2) of the substrate 1105 on the side of the fixing nip portion N, the surface protection layer 1108 of an insulating material (glass according to the embodiment) is formed by coating. The surface protection layer 1108 covers the thermistors T1-T7, the conductive pattern ET1-ET7, and the common conductive pattern EG11. However, in order to ensure connection with the electrical contacts, a part of the conductive pattern and a part of the common conductive pattern are exposed at both ends of the heater 1100 as shown in FIG. 5B.

Figure 6:
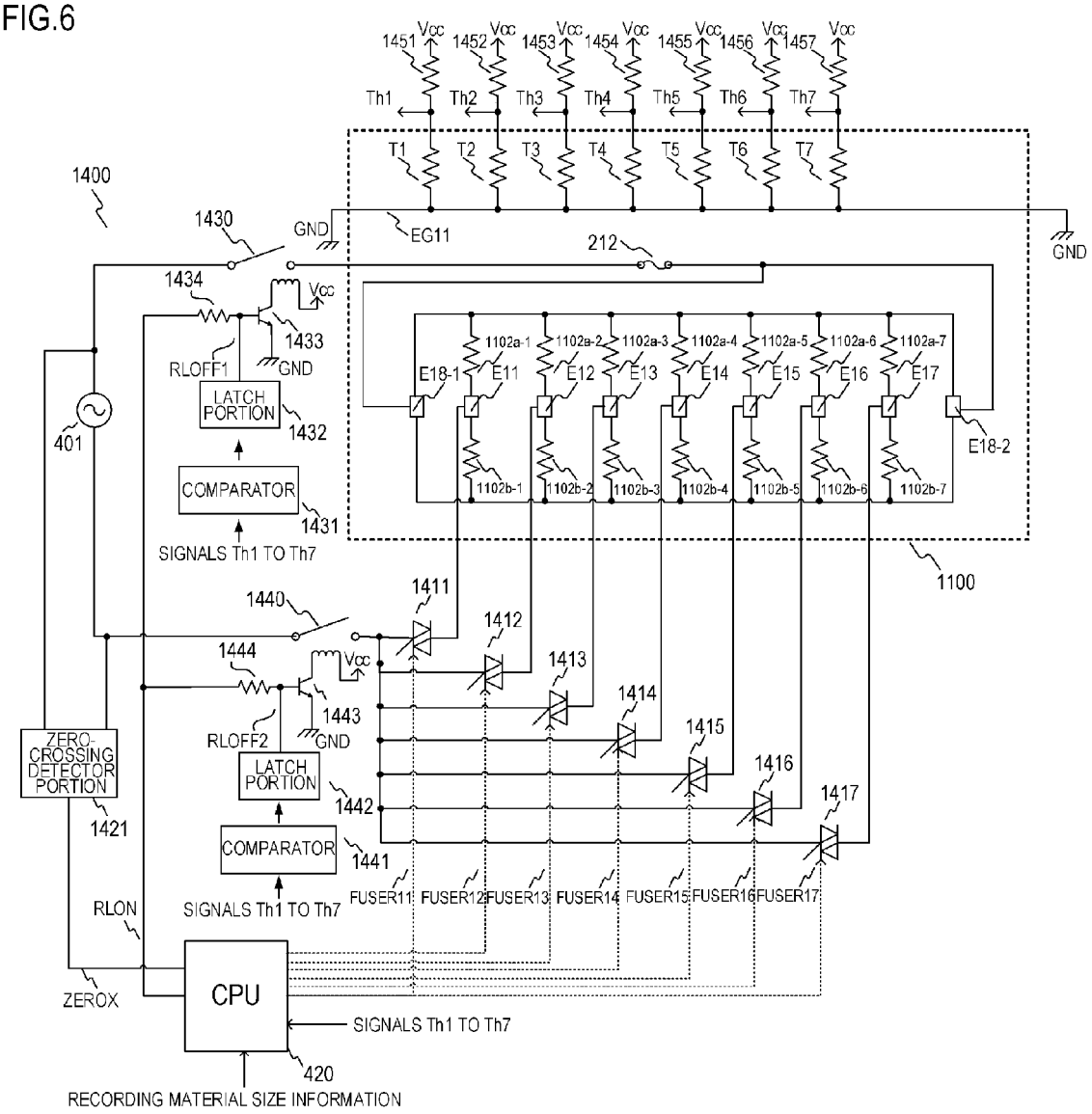
FIG. 6 is a control circuit diagram of the heater.

FIG. 6 is a circuit diagram of a control circuit 1400 as a controller for the heater 1100. Power control of the heater 1100 is performed by energizing/shutting off triacs 1411 to 1417. The triacs 1411 to 1417 each operate according to signals FUSER11 to FUSER17 from a CPU 420 as the controller.

The control circuit 1400 for the heater 1100 has a circuit configuration capable of independently controlling the seven heat-generating blocks HB11 to HB17 by the seven triacs 1411 to 1417. In FIG. 6, the drive circuit for the triacs 1411 to 1417 is not shown.

A_zero crossing detector 1421 is a circuit for detecting the zero crossing of the AC power supply 401 and outputs a signal ZEROX to the CPU 420. The signal ZEROX is used for example as a reference signal for phase control of the triacs 1411 to 1417.

Next, a method for detecting the temperature of the heater 1100 will be described. The temperature of the heater 1100 is detected by the thermistors T1 to T7. The CPU 420 receives, as inputs, signals (Th1 to Th7) obtained by voltage-dividing the voltage Vcc by the resistance values of the thermistors T1 to T7 and the resistance values of resistors 1451 to 1457. For example, the signal Th4 is a signal obtained by voltage-dividing the voltage Vcc by the resistance value of the thermistor T4 and the resistance value of the resistor 1454. The thermistor T4 has a resistance value corresponding to the temperature, and therefore when the temperature of the heat-generating block HB14 changes, the level of the signal Th4 input to the CPU 420 also changes. The CPU 420 converts each input signal into a temperature corresponding to the level.

The CPU 420 calculates power supply on the basis of a set temperature (control target temperature) for each of the heat-generating blocks and a temperature sensed by each of the thermistors, for example, by PI control. Furthermore, the calculated power supply is converted to a control timing such as a corresponding phase angle (phase control) or wavenumber (wavenumber control), and the triacs 1411 to 1417 are controlled in this control timing. Since signals corresponding to other thermistors are similarly processed, a description will not be provided.

A relay 1430 and a relay 1440 are mounted as means for shutting off power to the heater 1100 when the heater 1100 is overheated for example because of a failure of the apparatus.

The circuit operation of the relay 1430 and the relay 1440 will be described. When a signal RLON output from the CPU 420 attains a high state, a transistor 1433 is turned on and the secondary coil of the relay 1430 is energized from the DC power supply (voltage Vcc) so that the primary side contact of the relay 1430 is turned on. When the signal RLON attains a low state, the transistor 1433 is turned off, the current flowing from the power supply (voltage Vcc) to the secondary coil of the relay 1430 is interrupted, and the primary side contact of the relay 1430 is turned off. Similarly, when the signal RLON attains a high state, a transistor 1443 is turned on and the secondary coil of the relay 1440 is energized from the power supply (voltage Vcc), so that the primary side contact of the relay 1440 is turned on. When the signal RLON attains a low state, the transistor 1443 is turned off, the current flowing from the power supply (voltage Vcc) to the secondary coil of the relay 1440 is interrupted, and the primary side contact of the relay 1440 is turned off. Resistors 1434 and 1444 are current limiting resistors which limit the base current of the transistors 1433 and 1443.

Now, the operation of a protection circuit (a hardware circuit not through the CPU 420) using the relays 1430 and 1440 will be described. When the level of any one of the levels of the signals Th1 to Th7 exceeds a prescribed value set in a comparator 1431, the comparator 1431 activates a latch portion 1432, and the latch portion 1432 latches a signal RLOFF1 in a low state. When the signal RLOFF1 is in the low state, the relay 1430 can be kept in an off state (safe state) because the transistor 1433 is kept in an off state even when the CPU 420 pulls the signal RLON to a high state. Note that the signal RLOFF1 is the output of the latch portion 1432 in an open state in a non-latching state.

Similarly, when any one of the levels of the signals Th1 to Th7 exceeds a prescribed value set in a comparator 1441, the comparator 1441 activates a latch portion 1442, and the latch portion 1442 latches a signal RLOFF2 in a low state. When the signal RLOFF2 is in the low state, the transistor 1443 is kept in an off state even when the CPU 420 is in a high state of the signal RLON, so that the relay 1440 can be kept in an off state (safe state). In a non-latching state, the latch portion 1442 provides the signal RLOFF as an output in an open state. The prescribed value set in the comparator 1431 according to the embodiment and the prescribed value set in the comparator 1441 are both a value equivalent to 300° C.

Next, control of the temperature of the heater 1100 will be described. During the fixing process, each of the heat-generating blocks HB11 to HB17 is controlled so that the temperature sensed by the thermistor is maintained at a set temperature (control target temperature). More specifically, the power supplied to the heat-generating block HB14 is controlled by controlling driving of the triac 1414 so that the temperature sensed by the thermistor T4 is maintained at the set temperature. In this way, each of the thermistors is used in performing control to maintain a corresponding one of the heat-generating blocks at a constant temperature.

According to the embodiment, the film surface temperature required for fixing a toner image on a general sheet is 180° C., and the heater can be controlled at 240° C. in the sheet-passing part in order to obtain a desired film temperature. When the temperature of the film varies in the longitudinal direction, the film is offset in the direction of the high temperature part, which gives rise to a failure in transporting the recording material or a film damage, and therefore the non-sheet-passing part is similarly controlled so that the film surface temperature is 180° C. In the non-sheet-passing part, the recording material is not deprived of heat, the members in the part store the heat, and therefore, when the heater temperature is controlled at 200° C., the film surface can be kept at 180° C.

The CPU 420 changes the target temperature for each of the heat-generating blocks on the basis of the size information about the recording material. For example, when printing on a Letter size sheet, the heat-generating blocks HB1 to HB7 all correspond to the sheet-passing parts, and thus all the heat-generating blocks are controlled at a target temperature of 240° C. Meanwhile, when printing on a B5-size sheet, the heat-generating blocks HB1, HB2, HB6, and HB7 are non-sheet passing parts and the heat-generating blocks HB3 to HB5 are sheet-passing parts. Therefore, the heat-generating blocks HB1, HB2, HB6, and HB7 are controlled at a target temperature of 200° C., and the heat-generating blocks HB3 to HB5 are controlled at a target temperature of 240° C. The CPU 420 performs PI control on the basis of a target temperature for each of the heat-generating blocks and a sensing temperature by each of the thermistors, and calculates power required to set the heat-generating block to the target temperature. The required power varies depending on the temperature (° C.) at which the heater is maintained and whether the recording material actually passes the heat-generating block. Table 1 shows the degree of how much power must be supplied to maintain the heater at a prescribed temperature when the maximum power output for the heater according to the embodiment is 100%.

TABLE 1

| | Maintained at 240° C. | Maintained at 200° C. |
|---|---|---|
| Heat-generating block passed by recording material | 60% | 50% |
| Heat-generating block not passed by recording material | 40% | 30% |

The percentage of the power required to maintain the heater temperature at 240° C. is 60% when the recording material actually passes the heat-generating block. However, when the recording material does not pass the block, the recording material is not deprived of heat, so that the block can be maintained at 240° C. with a percentage as low as 40%.

The relation applies to the power required to maintain the heater temperature at 200° C. and the heater temperature can be maintained with 50% of the power for the heat-generating block passed by the recording material and 30% of the power for the heat-generating block not passed by the recording material.

Figure 1:
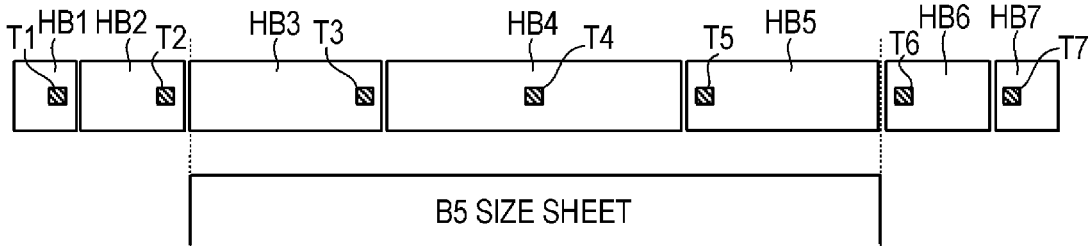
FIG. 1 illustrates the positional relation between heat-generating blocks and a recording material.
Figure 2A:
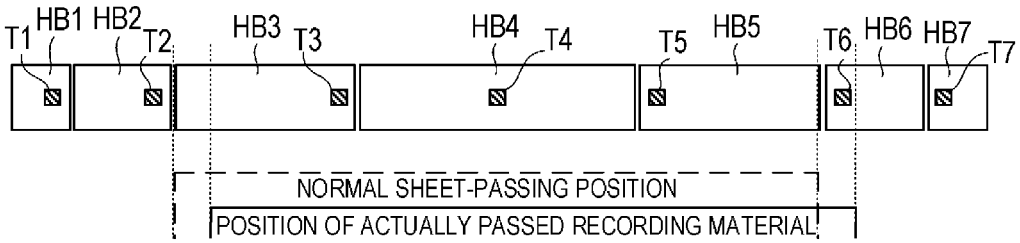
FIGS. 2A and 2B illustrate an example in which the positional relation between the heat-generating blocks and the recording material is disturbed.
Figure 2B:
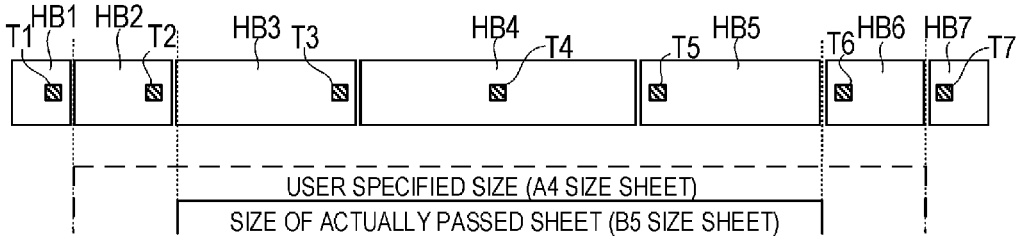

Here, as shown in FIG. 2A, the case in which a recording material is set and passed in a location shifted from the normal position (hereinafter referred to as "offset") will be described by way of illustration. In this example, the sheet-passing position (transport position) of a B5-size sheet is offset to the right from the normal sheet-passing position in the figure in the direction perpendicular to the transport direction.

Figure 7:
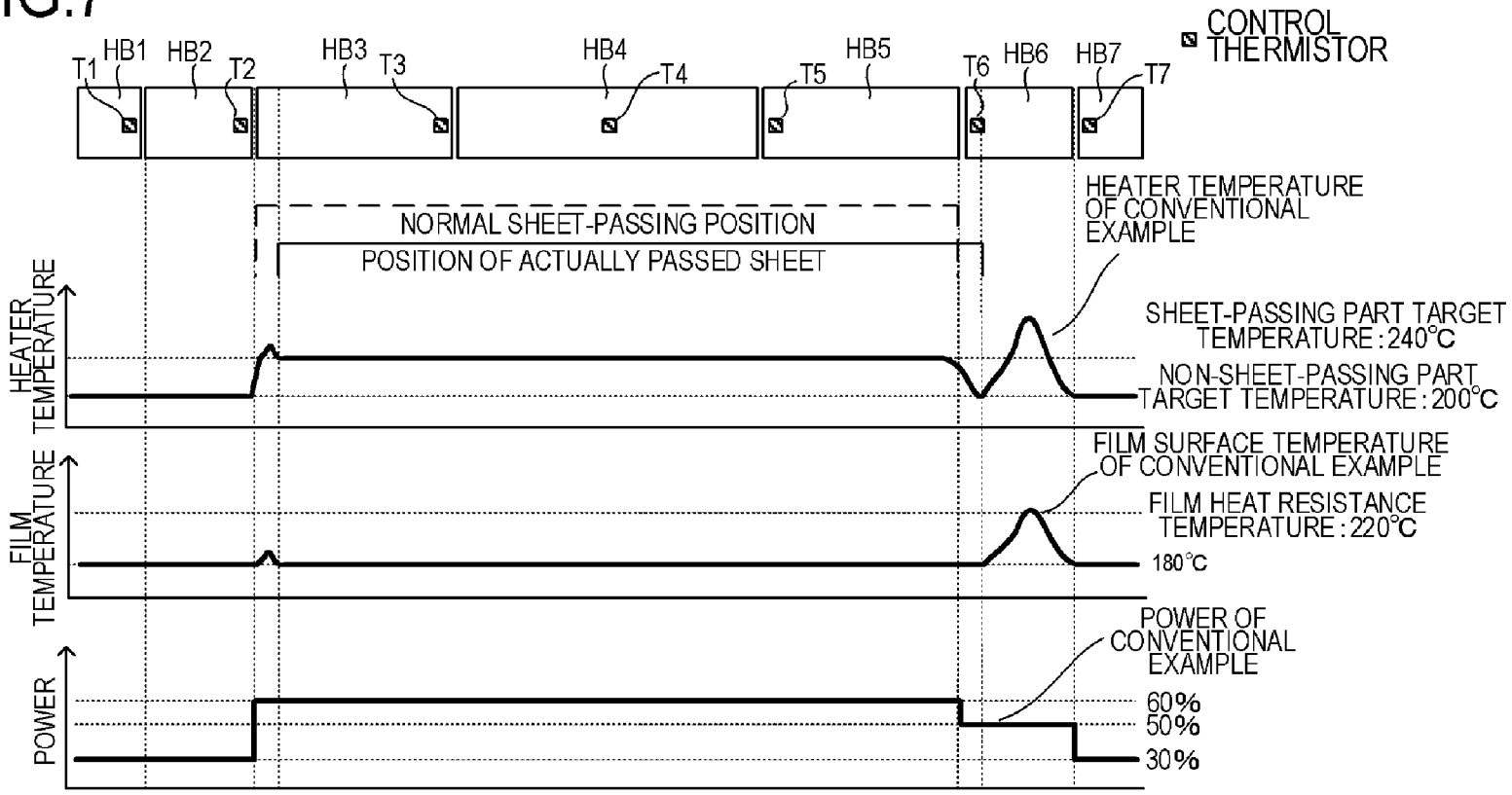
FIG. 7 illustrates the temperature distribution of a comparative example with respect to a first embodiment of the invention.

As a comparative example with respect to the embodiment, FIG. 7 shows the longitudinal distributions of the heater temperature, the film temperature, and the power input to each of the heat-generating blocks when the temperature control is carried out to the heat-generating block by a corresponding thermistor provided in the heat-generating block as in the conventional example.

Using width information about the recording material obtained from the image forming apparatus, heat-generating blocks HB1, HB2, HB6, and HB7, which are supposed to be non-sheet passing parts, control the heater at 200° C. as a target temperature for a non-sheet passing part. However, the heat-generating block HB6 loses heat as the recording material passes the position of the thermistor T6, and the power required to maintain the thermistor T6 at 200° C. should be larger than that for the heat-generating blocks HB1, HB2, and HB7. As a result, the temperatures of the heater and the film are raised in the position of the heat-generating block HB6 where the recording material does not pass. When the sheet continues to be passed in this condition, the pressing member may thermally expand at the temperature raised part, so that a failure in transporting the recording material may be caused or a damage may be caused as the temperature exceeds the heat resistance temperature of the film (220° C.).

Figure 8:
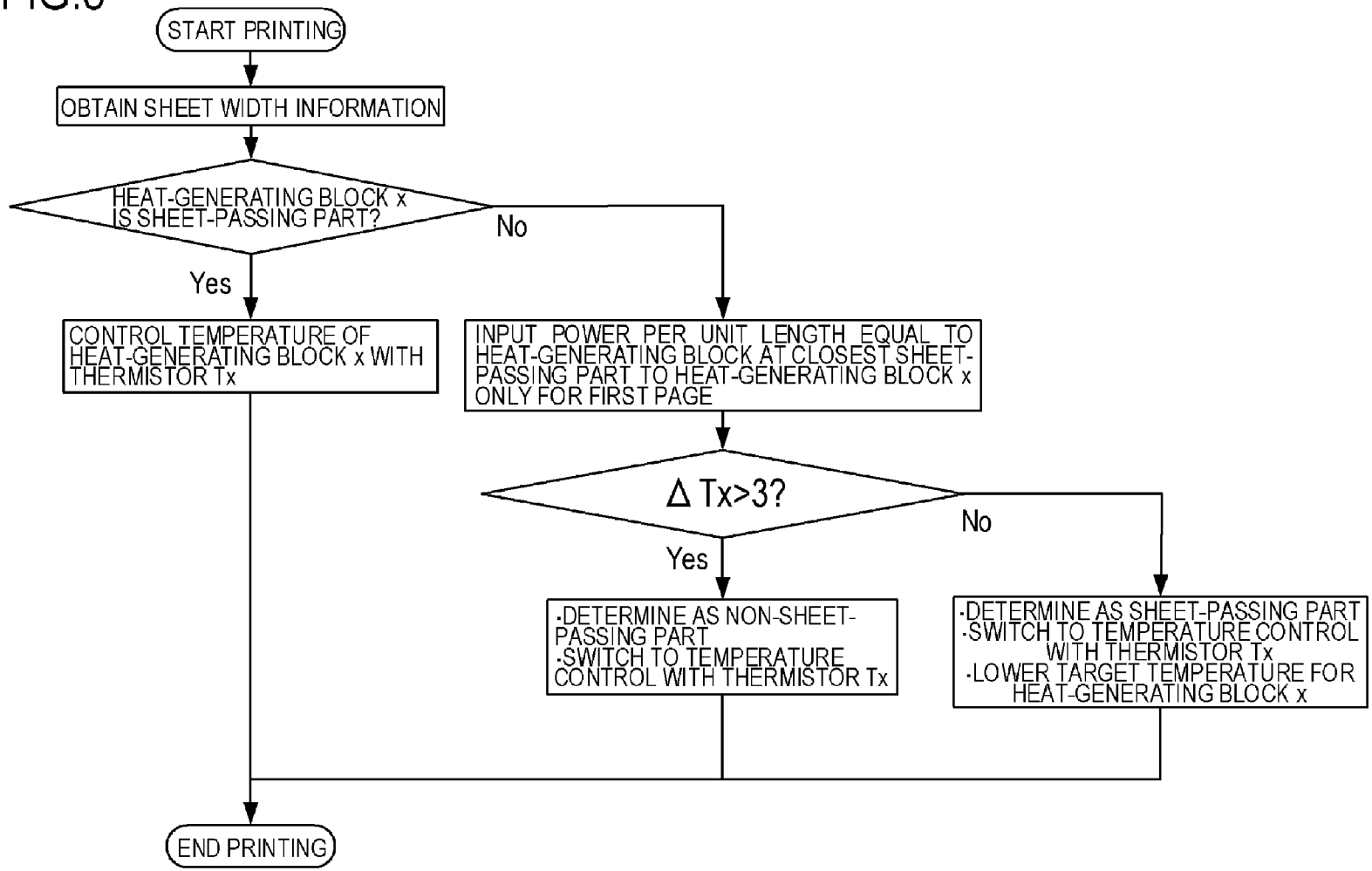
FIG. 8 is a flow chart for illustrating the first embodiment.

In order to solve the problem, according to the embodiment, when heating is continuously performed to images formed on a plurality of sheets of the recording material having the same size, the following control is performed using width information about the recording material. More specifically, as for a heat-generating block supposed to be a non-sheet-passing part, a thermistor provided at the heat-generating block is not used for temperature control, and power per unit length equal to that for a heat-generating block supposed to be a sheet-passing part is input only for the first page. In other words, power is supplied so that the ratio of actually input power to the maximum power that can be input for each of the heat-generating blocks is set equal among the heat-generating blocks. Then, the position in which the recording material is actually passed is estimated on the basis of temperature transition in each of the thermistors at the time. From the second page onwards, the temperature control with the thermistor provided at the heat-generating block is resumed, and the target temperature at the time is optimized using the estimated position of the recording material. FIG. 8 is a flow chart for illustrating the control according to the embodiment.

An example of how a B5 size sheet is passed will be described. Since the heat-generating blocks HB3, HB4, and HB5 correspond to sheet-passing parts on the basis of information obtained from the image forming apparatus, the heat-generating blocks are controlled at 240° C. as a target temperature for the sheet-passing part using the thermistors T3, T4, and T5 of these blocks. Meanwhile, since the heat-generating blocks HB1, HB2, HB6, and HB7 correspond to non-sheet passing parts, power per unit length equal to the heat-generating block at the closest sheet-passing part is input only for the first page. More specifically, the heat-generating blocks HB1 and HB2 are supplied with power per unit length equal to that supplied to the heat-generating block HB3 and the heat-generating blocks HB6 and HB7 are supplied with power per unit length equal to that supplied to the heat-generating block HB5. The thermistors T1, T2, T6, and T7 are used as thermistors for temperature detection.

Subsequently, one sheet of the recording material passes, the position in which the recording material actually passes is estimated. The estimation is carried out depending on how the temperature of each thermistor changes during passing of one sheet. When the tip of the recording material enters the fixing apparatus, the temperature of each thermistor is expressed by Tsx (x=1, 2, 6, 7), the temperature of the thermistor when the rear end of the recording material exits the fixing apparatus is expressed by Tex (x=1, 2, 6, 7), and the temperature change along the single sheet is expressed by $\Delta Tx$ (x=1, 2, 6, 7). Here, $\Delta Tx = Tex - Tsx$ holds.

The heat-generating blocks HB1, HB2, HB6, and HB7 are supplied with 60% of the power equal to the power required to maintain the heat-generating blocks HB3 and HB5 as the sheet-passing parts at 240° C. only for the first page. If the recording material passes the heat-generating blocks HB1, HB2, HB6, and HB7, the thermistor temperature at the heat-generating blocks remains at 240° C. similarly to the heat-generating blocks HB3 and HB5 as the sheet-passing parts, and ΔTx is approximately 0° C. Meanwhile, if the recording material is not passed, heat is not lost, so that the thermistor temperature rises from 240° C., and ΔTx>0° C. results. According to the embodiment, when ΔTx>3° C., it is determined that the thermistor position is at a non-sheet-passing part in consideration of the variation in the thermistor temperature.

Figure 9:
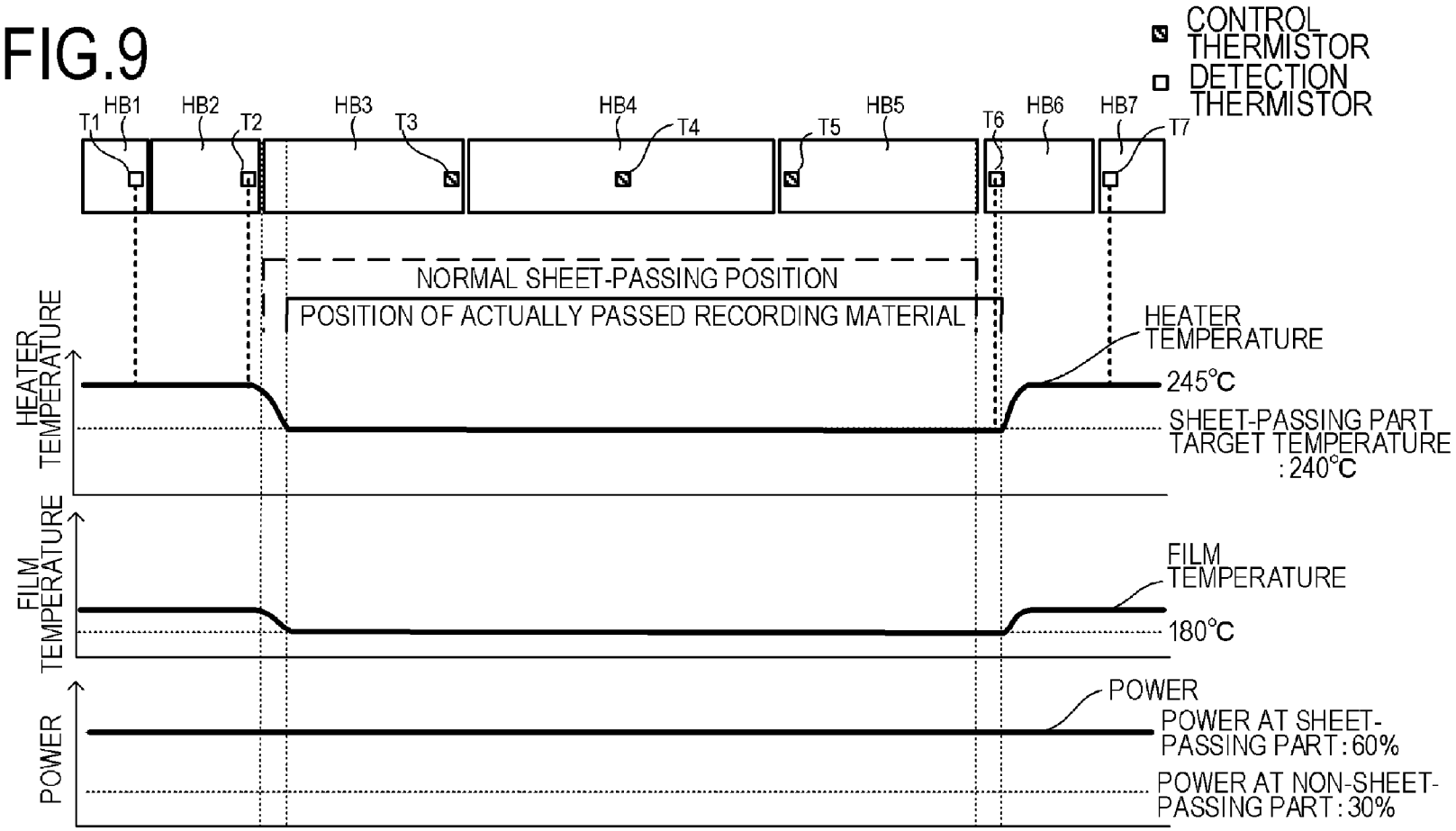
FIG. 9 illustrates a temperature distribution in a time point for determining the position of a recording material according to the first embodiment.

When a B5-size sheet is offset and the control according to the embodiment is carried out, the longitudinal distribution of the heater temperature at the time when the first page exits the fixing apparatus is as shown in FIG. 9. The thermistor temperature of the thermistors T1, T2, and T7, which is 240° C. when the sheet tip end enters the fixing apparatus, rises to 245° C. and ΔTx=5° C. Meanwhile, the thermistor T6 is deprived of heat by the recording material, and the thermistor temperature remains unchanged even when the recording material passes, so that ΔTx is approximately 0° C. As can be understood from the result, it can be presumed that the thermistors T1, T2, and T7 correspond to non-sheet-passing parts, while the thermistor T6 corresponds to a sheet-passing part, and the B5-sized sheet is offset to the position overlapping the thermistor T6.

Figure 10:
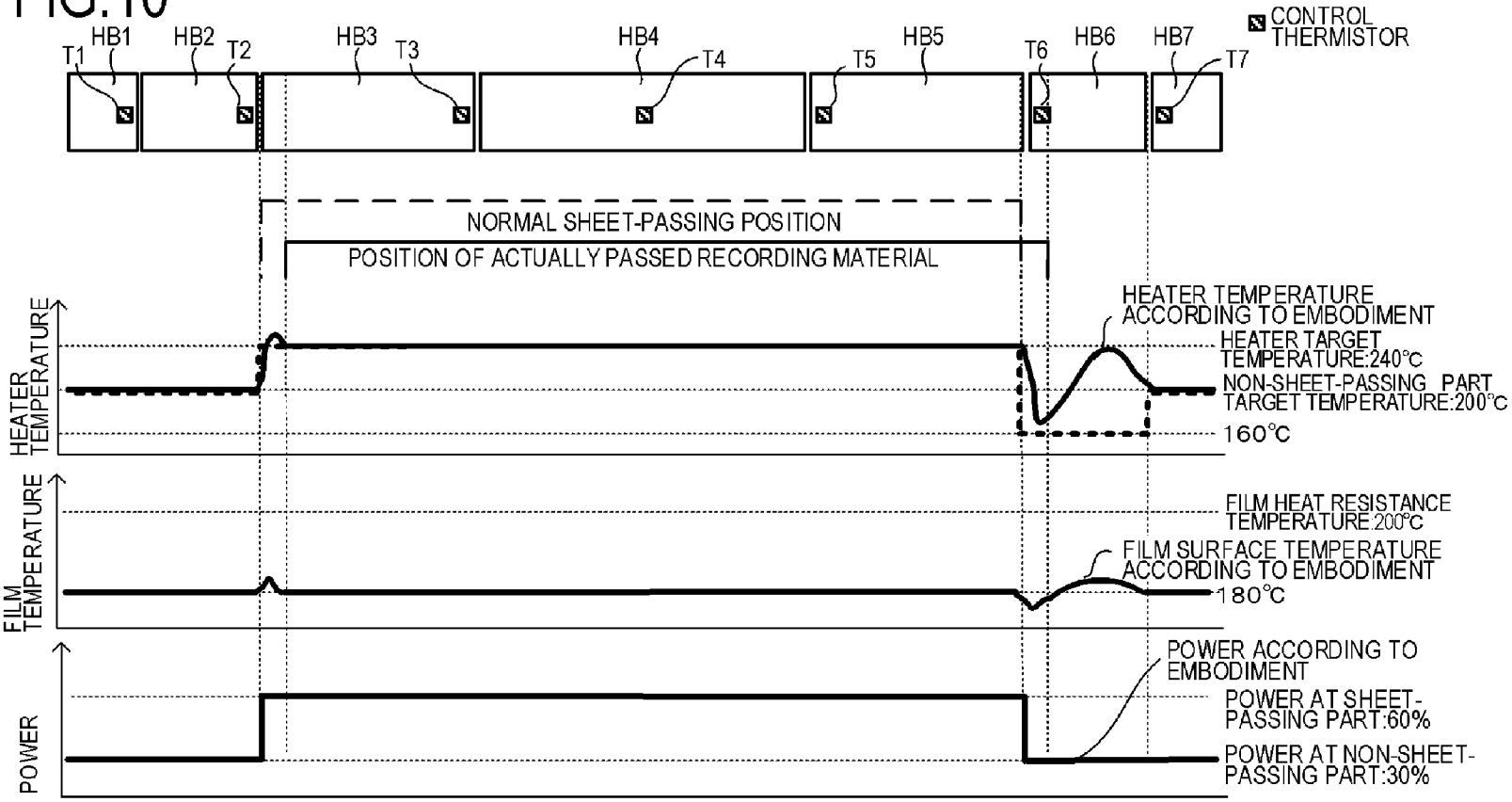
FIG. 10 illustrates a temperature distribution according to the first embodiment.

After the position in which the recording material actually passes is estimated, a thermistor which controls each of the heat-generating blocks is switched back to the thermistor attached to the heat-generating block in order to control the heat-generating blocks at the optimum temperature. At the time, the heater target temperature for the heat-generating block HB6, which is originally a non-sheet passing part but the recording material passes its thermistor position, is set to 160° C. which is lower than the other zones as shown in FIG. 10. As a result, even if the temperature rises at the part of the heat-generating block HB6 or at the non-sheet-passing part in which the recording material does not pass while the sheets continue to be passed, the film temperature takes the temperature distribution shown in FIG. 10, and the temperature can be maintained below the temperature at which a recording material transport failure or a damage may be caused.

According to the embodiment, as a change in the control condition for the offset countermeasure, the target temperature for the heat-generating block with the offset is lowered, but the control condition is not limited to this. For example, the temperature increase at the non-sheet-passing part may be suppressed by increasing the sheet feeding interval (the transport interval of the plurality of sheets of the recording material which continuously pass the fixing nip portion).

Second Embodiment

In the description of the first embodiment, the recording material offset from the normal position is passed. In the following description of a second embodiment of the invention, width information about a recording material is unknown. Note that the same items as those according to the first embodiment such as the structure of the main body will not be described.

In an image forming apparatus which cannot obtain width information about a recording material, the entire longitudinal region is controlled to a target temperature for a sheet-passing part assuming that the recording material exists in the entire longitudinal region.

Figure 11:
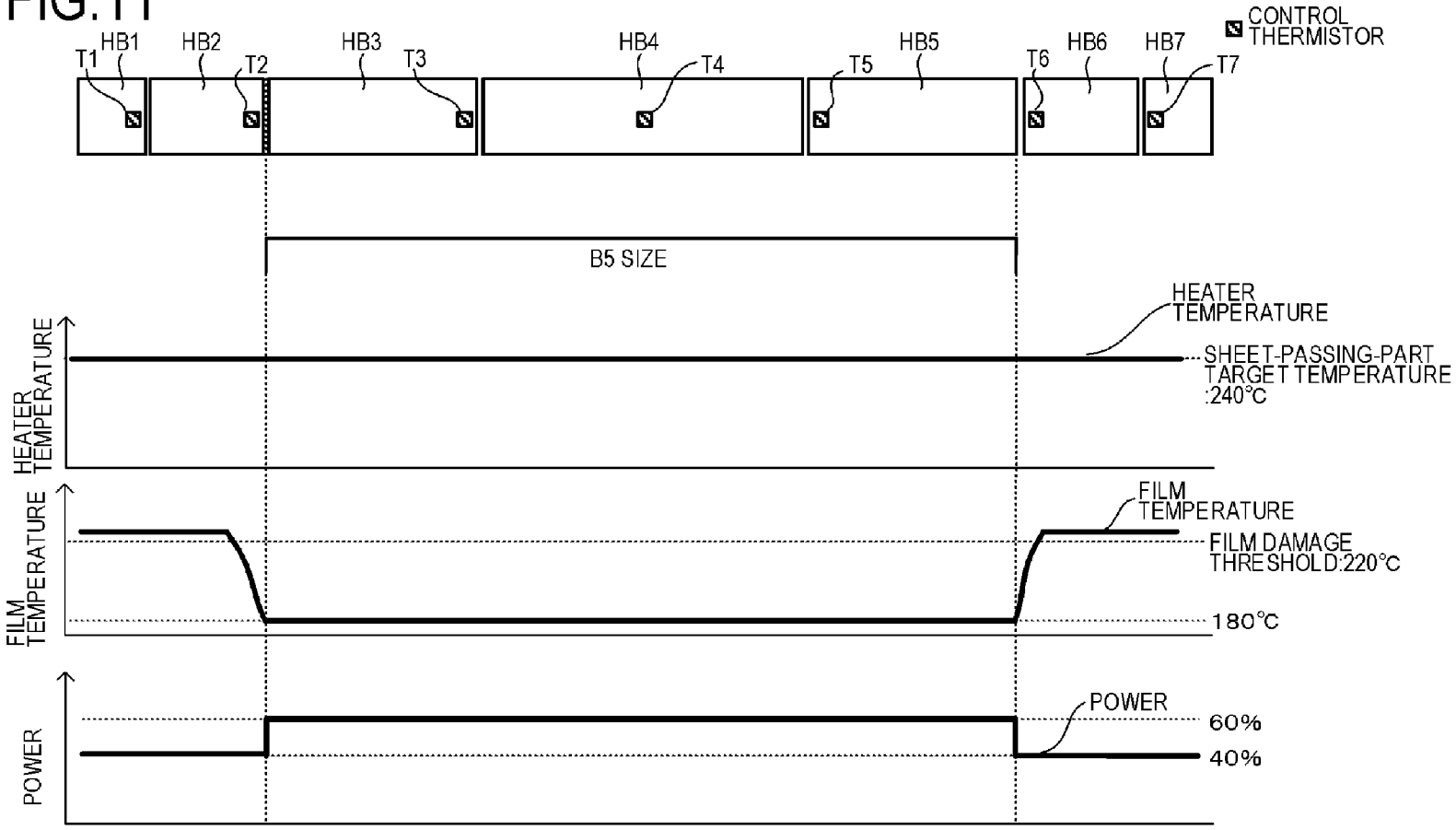
FIG. 11 illustrates a temperature distribution according to a comparative example with respect to a second embodiment of the invention.

Here, a sheet actually passed is a B5 size sheet by way of illustration. As a comparative example with respect to the embodiment, FIG. 11 shows the longitudinal distributions of the heater temperature and the film surface temperature when the temperature control at each of the heat-generating blocks is carried out using a thermistor disposed in the heat-generating block as in the conventional example. Although the heater temperature is controlled at 240° C. as a target temperature for a sheet-passing part in the entire longitudinal region, the recording material does not pass the heat-generating blocks HB1, HB2, HB6, and HB7 and is not deprived of heat, so that the film temperature rises as a result. The film temperature may exceed the heat resistance temperature and cause a damage.

Figure 12:
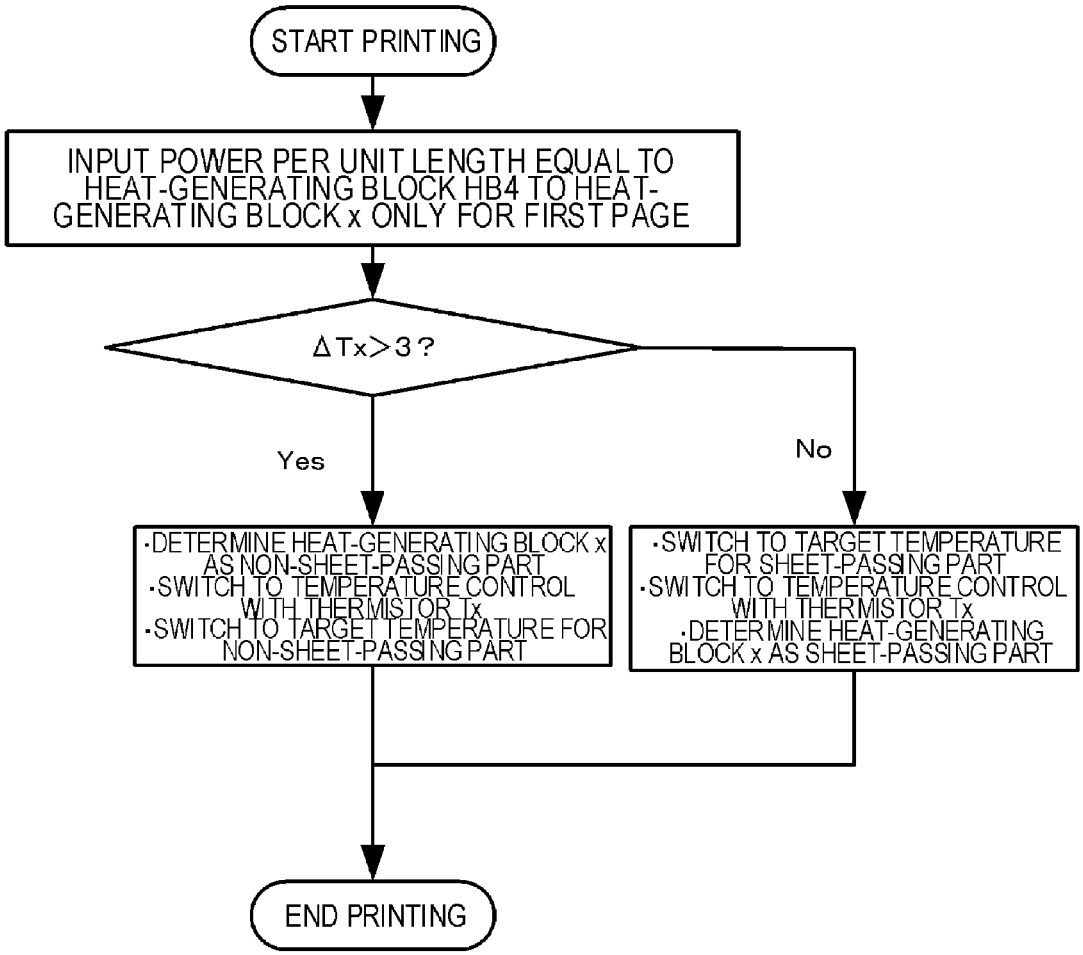
FIG. 12 is a flowchart for illustrating the second embodiment.

In order to solve the problem, according to the embodiment, when heating is continuously performed to images formed on a plurality of sheets of the recording material having the same size, and the width information about the recording material is not available, the following control is performed. More specifically, the temperature of the heat-generating block HB4 as a reference heat-generating block is subjected to control using the thermistor T4, but the heat-generating blocks HB1 to HB3 and HB5 to HB7 are not subjected to the temperature control using a thermistor disposed in each of the heat-generating blocks only for the first page as heat-generating blocks other than the reference heat-generating block. More specifically, the heat-generating blocks HB1 to HB3 and HB5 to HB7 are supplied with power per unit length equal to that input to the heat-generating block HB4. At the time, from the temperature transition at each of thermistors, the position in which the recording material is actually passed is estimated. From the second page onwards, the temperature control with the thermistor provided at the heat-generating block is resumed, and the target temperature at the time is optimized using the estimated position of the recording material. The operation of the heat-generating blocks HB1 to HB3 and HB5 to HB7 according to the embodiment is illustrated in the flowchart in FIG. 12.

In the image forming apparatus according to the embodiment, the sheet-passing reference position is set to the longitudinal center, and the recording material passes the thermistor T4 without fail. Meanwhile, the recording material does not always pass the other thermistors. Therefore, the temperature transitions in the thermistors T1 to T3 and T5 to T7 are used to estimate whether the heat-generating blocks HB1 to HB3 and HB5 to HB7 actually pass the sheets.

First, equal power per unit length is input to all the heat-generating blocks. The thermistors T1 to T3 and T5 to T7 are used as thermistors for temperature detection.

Subsequently, when one sheet of the recording material passes, the position in which the recording material actually passes is estimated. The estimation is carried out depending on how the temperature of each of the thermistors changes during passing of the single sheet of the recording material.

The temperature of each of the thermistors when the front end of the sheet enters the fixing apparatus is expressed by Tsx (x=1=3, 5 to 7), the temperature of the thermistor when the rear end of the sheet exits the fixing apparatus is Tex (x=1=3, 5 to 7), and the temperature change along the single sheet is expressed by ΔTx (x=1=3, 5 to 7). Here, ΔTx=Tex−Tsx holds. Among the thermistors for detection, the thermistor passed by the recording material remains at 240° C. as a target temperature for a sheet-passing part, and therefore ΔTx is approximately 0° C. Meanwhile, the temperature of the thermistor which is not passed by the recording material rises from 240° C. and ΔTx>0° C. results. According to the embodiment, when ΔTx>3° C., it is determined that the thermistor position is at a non-sheet-passing part in consideration of the variation in the thermistor temperature.

Figure 13:
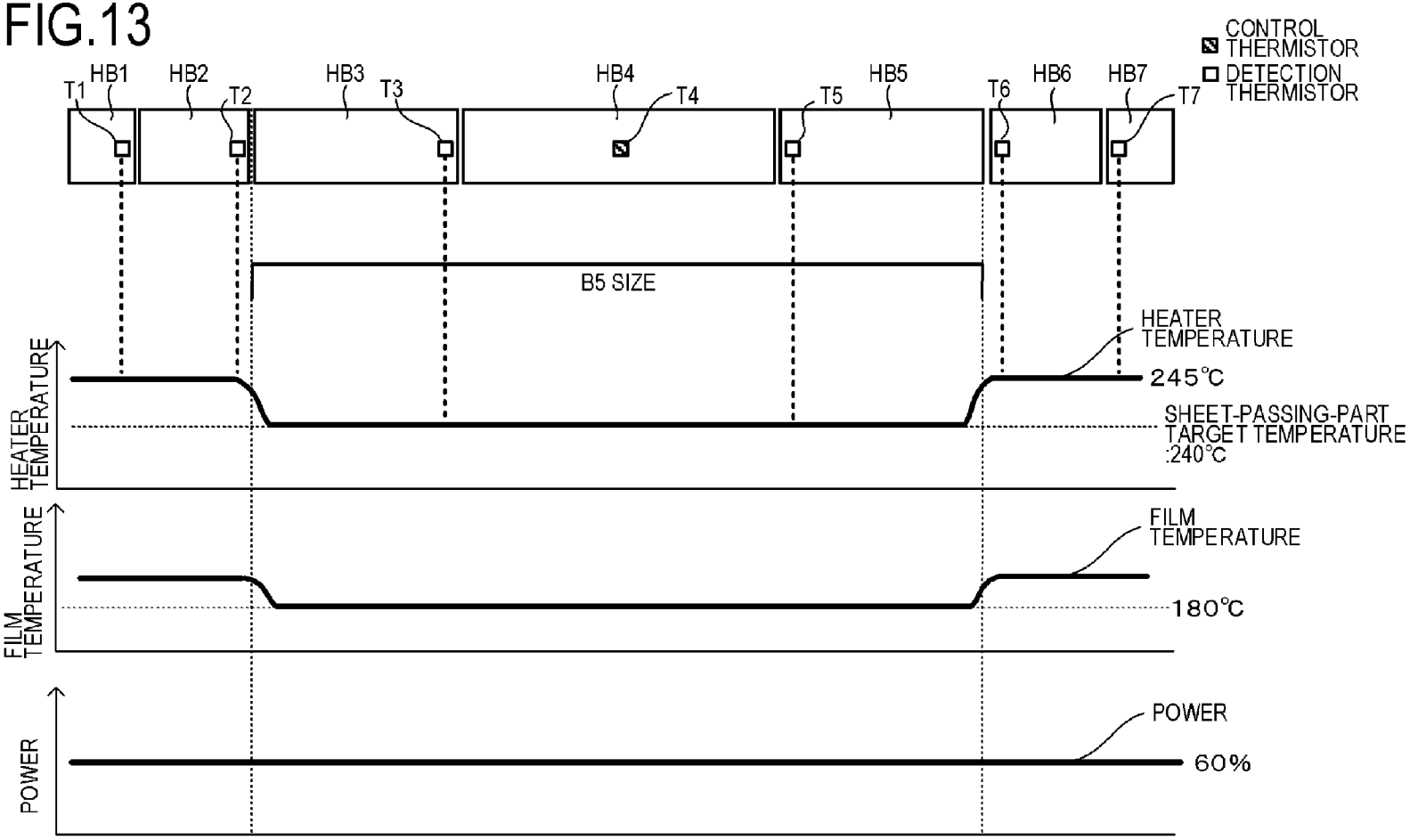
FIG. 13 illustrates a temperature distribution in a time point for determining the position of a recording material according to the second embodiment.

When the control according to the embodiment is carried out and the passed sheet is a B5 size sheet, the longitudinal distribution of the heater temperature at the time when the paper exits the fixing apparatus is as shown in FIG. 13. The thermistor temperature of the thermistors T1, T2, T6, and T7, which is 240° C. when the sheet tip enters the fixing apparatus, rises to 245° C. and ΔTx=5° C. Meanwhile, the thermistor temperature of the thermistors T3 and T5 is unchanged when the recording material passes, and ΔTx is approximately 0° C. As can be understood from the result, it can be presumed that the actually passed sheet has such a size that the heat-generating blocks HB3 to HB5 become sheet-passing parts.

Figure 14:
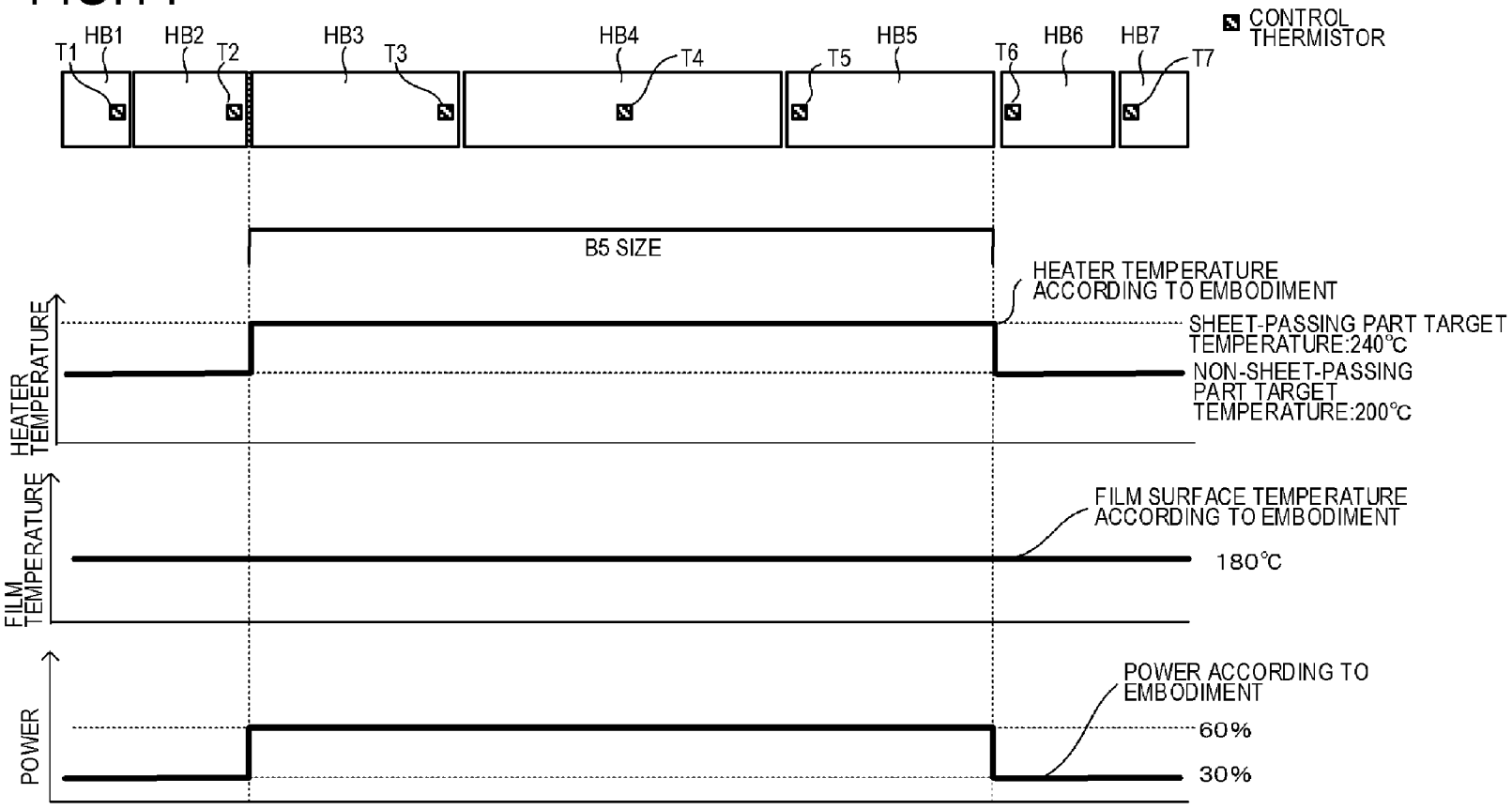
FIG. 14 illustrates a temperature distribution according to the second embodiment.

After the width of the recording material is estimated, the thermistor which control each of the heat-generating blocks is switched to the thermistor attached to the heat-generating block. In other words, the target temperature for the heat-generating block determined to be a sheet-passing part on the basis of the heater temperature is changed to 240° C. for a sheet-passing part, and the target temperature for the heat-generating block determined to be a non-sheet-passing part is changed to 200° C. for a non-sheet-passing part. As a result, the longitudinal distribution of the film temperature is constant at 180° C. as shown in FIG. 14, and the non-sheet-passing part temperature rise at the heat-generating block which is not passed by the recording material can be suppressed.

The above-described control allows the size of the sheet actually passed to be estimated even when the size information about the recording material is not available, so that the longitudinal distribution of the film temperature can be homogenized.

Third Embodiment

A method for estimating the width of an actually passed recording material according to a third embodiment of the invention will be described. According to the method, the width is estimated from power input to each of heat-generating blocks. The same items as those according to the first embodiment, such as the structure of the main body will not be described.

In the fixing apparatus according to the third embodiment, the heater is controlled at a prescribed temperature, but power required to maintain the prescribed temperature is different between a heat-generating block which is not passed by the recording material and a heat-generating block which is passed by the recording material as shown in Table 1 according to the first embodiment. The power difference is used to estimate the actual position in which the recording material passes.

Figure 15:
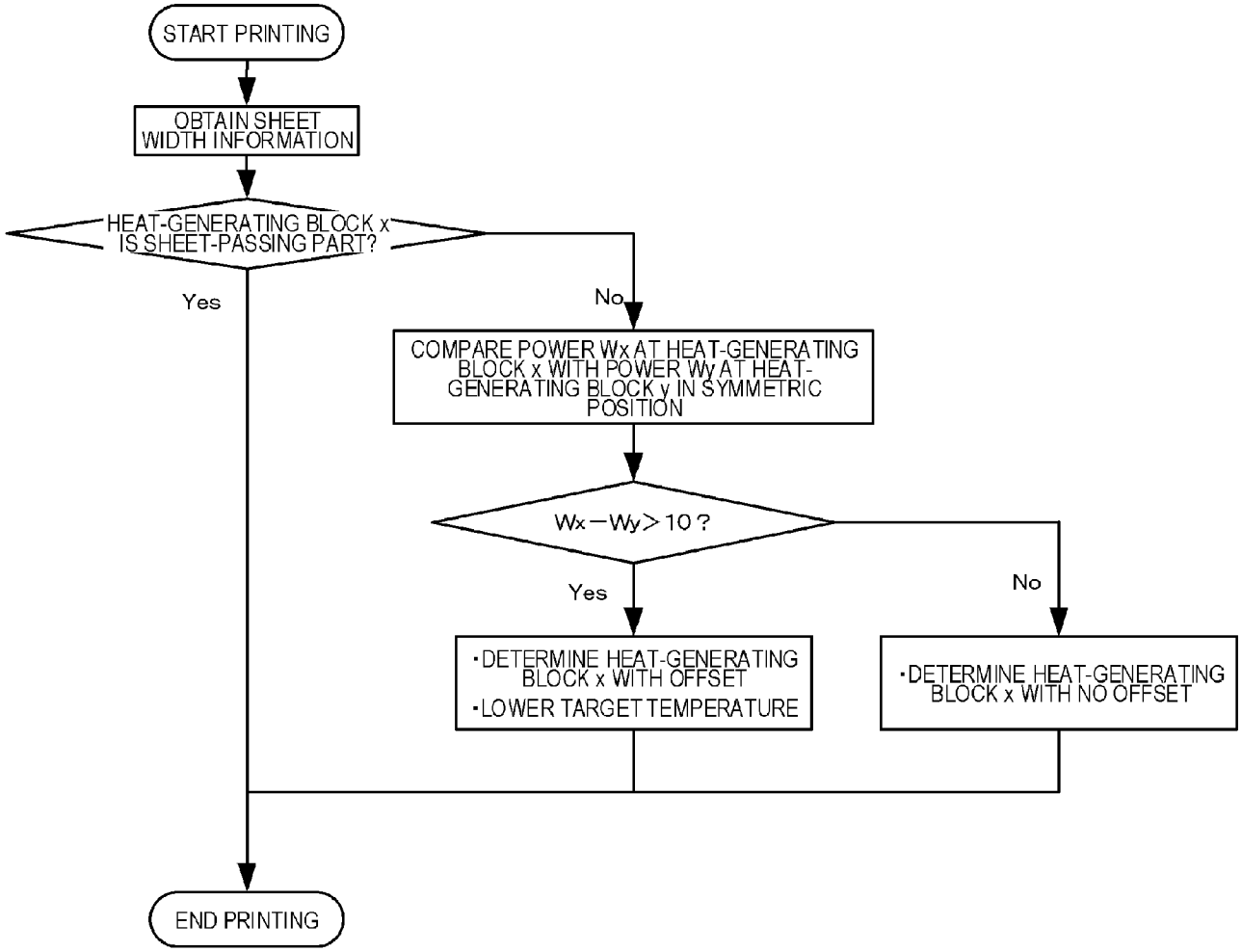
FIG. 15 is a flowchart for illustrating a third embodiment of the invention.

Similarly to the first embodiment, the case in which a B5 size sheet is offset will be described by way of illustration. A flowchart for illustrating the control according to the embodiment is shown in FIG. 15. First, width information about the recording material is obtained from the image forming apparatus, and it is determined whether the block corresponds to a sheet-passing part or a non-sheet-passing part. When the block corresponds to a non-sheet-passing part, in order to estimate whether the recording material is offset, the power at the block is compared with power at a heat-generating block symmetric to the block with respect to the longitudinal center of the heater. When a B5 size sheet is passed, the power at the heat-generating block HB1 as a non-sheet-passing part is compared with the power at the heat-generating block HB7 while the power at the heat-generating block HB2 is compared with the power at the heat-generating block HB6. As shown in Table 1, even when the heat-generating blocks are controlled at the same target temperature, there is a 20% difference in the power required to maintain the temperature depending on whether the recording material actually passes the heat-generating block. According to the embodiment, the power is compared between the heat-generating blocks symmetric with respect to the longitudinal direction, and when the power difference exceeds 10%, it is determined that an offset is present toward the heat-generating block with the higher power. The target temperature for the heat-generating block with the offset is lowered to 160° C. in order to reduce the non-sheet-passing part temperature increase. The power is compared constantly and the target temperature is changed when the power difference exceeds the threshold value.

Figure 16:
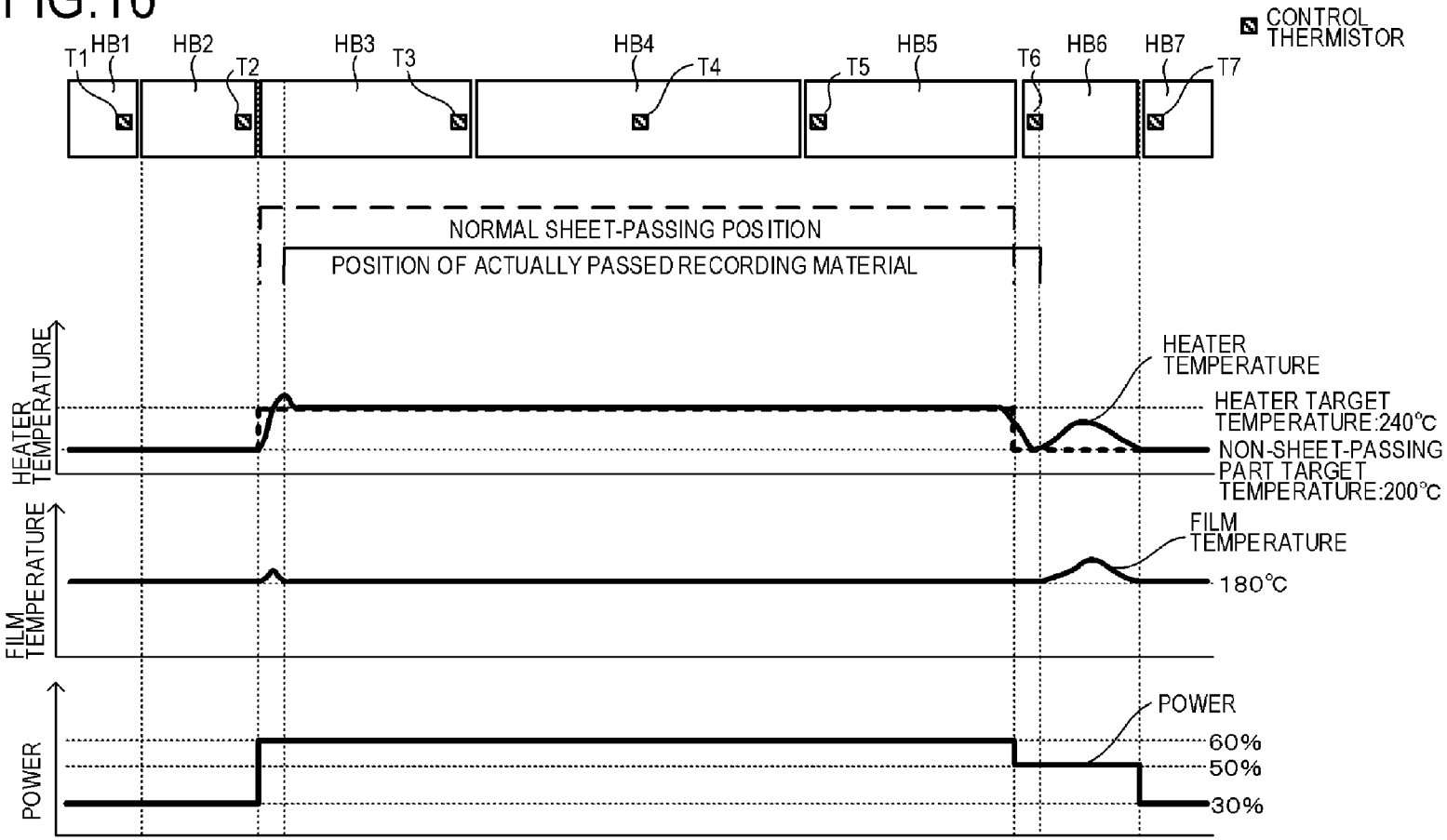
FIG. 16 illustrates a temperature distribution in a time point for determining the position of a recording material according to the third embodiment.

FIG. 16 shows the longitudinal distributions of the heater temperature, the film temperature, and the power input to each of the heat-generating blocks when five B5-size sheets are actually passed in an offset state. Since the heat-generating blocks HB1, HB2, HB6, and HB7 are non-sheet-passing parts, the heater target temperature is set to 200° C., and 30% of the power is initially input. However, the heat-generating block HB6 has a sheet offset at the position of the thermistor T6, so that heat is deprived, the power to maintain the heater at 200° C. increases, and at the time of passing the five sheets of paper, 50% of the power is input. Since the power difference between the heat-generating block HB6 and the heat-generating block HB2 exceeds 10% as the threshold value, it can be estimated that the recording material is offset in the direction of the heat-generating block HB6. From the estimation result, the heat-generating block HB6 is set to 160° C. which is lower than the other zones. As a result, even if the temperature rises at the part of the heat-generating block HB6 in which the recording material does not pass or at the non-sheet-passing part as the sheets continue to be passed, the film temperature takes a temperature distribution equal to that shown in FIG. 10, so that a recording material transport failure or a damage to the film can be prevented.

According to the embodiment, the power is compared between the heat-generating blocks symmetric with respect to the longitudinal center of the heater in order to determine the presence of an offset but the method is not limited to this. For example, the power may be compared between adjacent blocks corresponding to non-sheet-passing-parts such as the heat-generating blocks HB6 and HB7.

In addition, as a change in the control condition for the offset countermeasure, the target temperature for the heat-generating block with the offset is lowered, but the control condition is not limited to this. For example, the power input to the heat-generating block HB6 with an offset may be controlled with the same power input to the heat-generating block HB7 which is unaffected by the offset also at the non-sheet-passing-part and still the same effect can be provided.

Fourth Embodiment

According to the fourth embodiment, when width information about the recording material is unknown, a method for estimating the width of the recording material from power input to each of the heat-generating blocks will be described. The same items as those according to the first embodiment such as the structure of the main body will not be described.

In an image forming apparatus which cannot obtain width information about a recording material, a target temperature is controlled at 240° C., which is a target temperature for a sheet-passing part, in the entire longitudinal region, assuming that the recording material exists in the entire longitudinal region.

However, as shown in Table 1 according to the first embodiment, even when the heat-generating blocks are controlled at the same target temperature of 240° C., the power is 60% if the recording material passes and 40% if not, and there is a 20% difference depending on whether the recording material actually passes. The difference is used to estimate whether the heat-generating block corresponds to a sheet-passing part.

Figure 17:
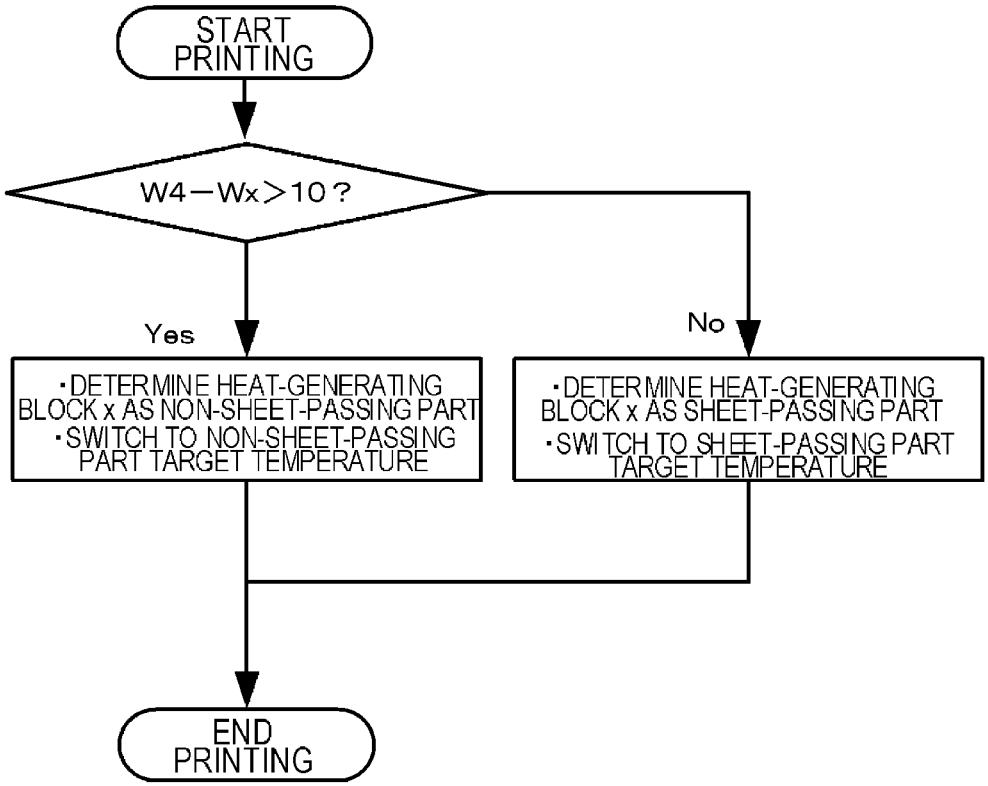
FIG. 17 is a flowchart for illustrating a fourth embodiment of the invention.

The operation of the heat-generating blocks according to the embodiment is illustrated in the flowchart in FIG. 17. Since the sheet-passing reference position is set to the longitudinal center in the image forming apparatus according to the embodiment, the recording material passes the heat-generating block HB4 without fail. Meanwhile, the recording material does not always pass the other thermistors. Therefore, the power Wx (x=1 to 3, 5 to 7) to each of the heat-generating blocks HB1 to HB3 and HB5 to HB7 is compared to the power W4 input to the heat-generating block HB4 in order to estimate whether the heat-generating block is a sheet-passing part or a non-sheet-passing part. According to the embodiment, when W4−Wx>10%, it is determined that the heat-generating block x is a non-sheet-passing-part, and the target temperature is changed to 200° C. as the target temperature for the non-sheet-passing-part.

Figure 18:
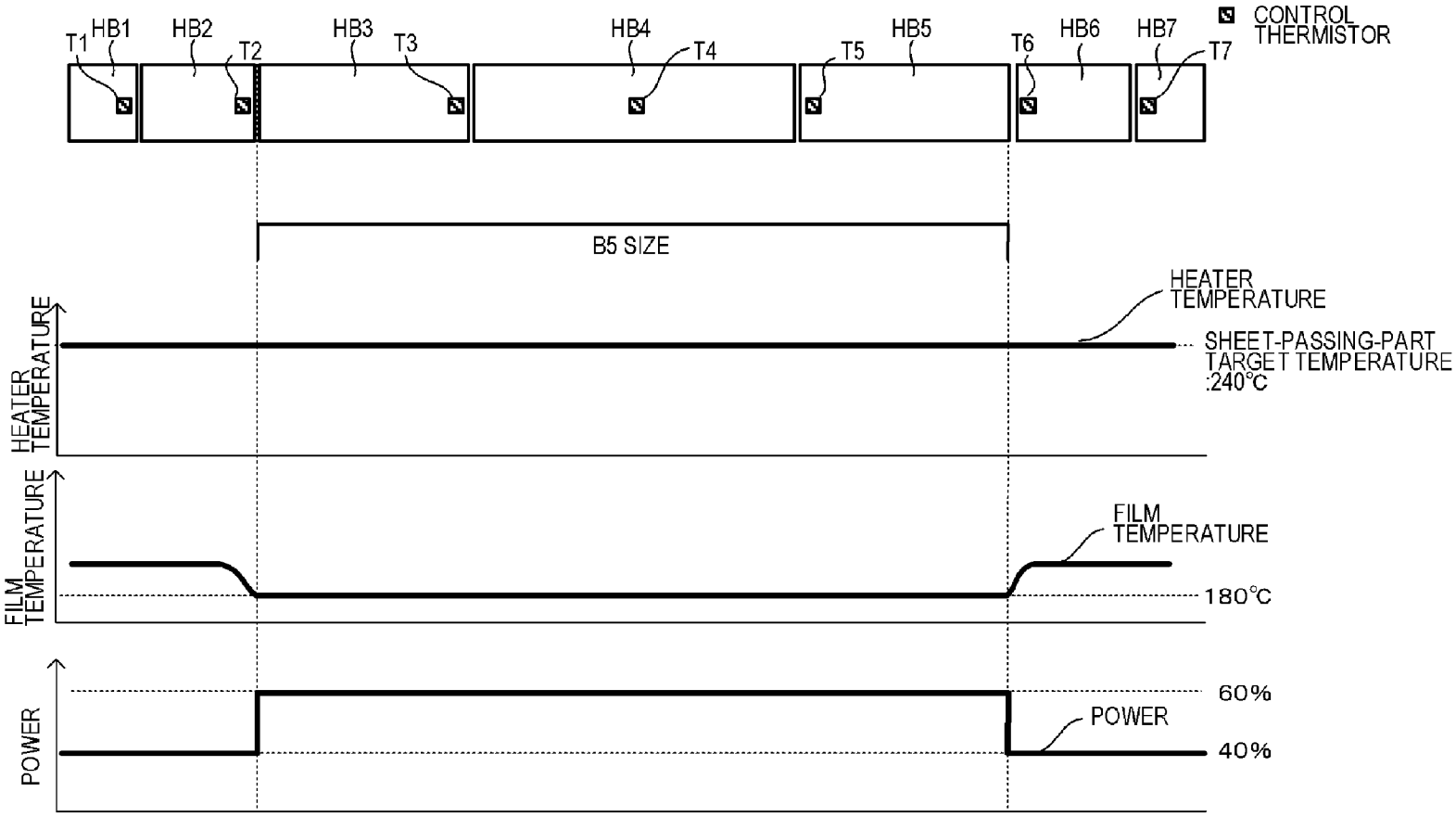
FIG. 18 illustrates a temperature distribution in a time point for determining the position of a recording material according to the fourth embodiment.

A case in which a B5-size sheet is passed while width information about the recording material is unavailable will be described by way of illustration. FIG. 18 shows the longitudinal distributions of the heater temperature, the film temperature, and the power input to each of the heat-generating blocks when five B5-size sheets are passed. Since no size information is available, the entire longitudinal region of the heater is controlled at 240° C. as the target temperature for a sheet-passing part. Since the heat-generating blocks HB3 and HB5 are sheet-passing parts, the power is maintained at 60%. Meanwhile, since the heat-generating blocks HB1, HB2, HB6, and HB7 are non-sheet-passing parts, the power required to maintain the heater at 240° C. is reduced to 40%. These kinds of power are compared with the power W4 at the heat-generating block HB4 as a reference, so that the sheet actually passed has such a size that the heat-generating blocks HB3 to HB5 become sheet-passing parts.

When the width of the recording material is estimated, the target temperature for the heat-generating block determined to be the sheet-passing part is changed to the target temperature for the sheet-passing part, and the target temperature for the heat-generating block determined to be the non-sheet-passing part is changed to the target temperature for the non-sheet-passing part. The control allows the size of the actually passed sheet to be estimated even when the size information about the recording material is not available, so that the temperature of each of the heat-generating blocks can be controlled to be an optimum value.

Although the first to fourth embodiments have been described, the methods according to the first to fourth embodiments may be used in combination rather than using the methods according to these embodiments individually.

For example, when size information about a recording material is not available, and the actual paper size must be estimated, the method according to the second embodiment may be selected to estimate the sheet size while controlling all the heat-generating blocks with the same power as the heat-generating block which is the sheet-passing-part. Alternatively, when size information is available but it is desired to determine whether an offset is generated, the method according to the third embodiment may be selected so that the presence or absence of the offset can be determined while controlling the temperatures at the non-sheet-passing part and the sheet-passing-part at prescribed temperatures.

More specifically, the features and configurations according to the embodiments may be combined in every possible manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-083097, filed on Apr. 24, 2019, which is hereby incorporated by reference herein in its entirety.

What is claimed is:

1. An image heating apparatus comprising:

a heating unit which includes a heater for heating an image formed on a recording material and has a plurality of divided heat-generating blocks in a direction orthogonal to a transport direction for the recording material;

a temperature detecting element which detects a temperature of each of the heat-generating blocks; and a controller which controls power to be supplied to each of the heat-generating blocks, wherein, when the image heating apparatus continuously heats images formed on a plurality of sheets of the recording material having an equal size, the controller determines whether each of the heat-generating blocks is a heat-generating block which is passed by the recording material or a heat-generating block which is not passed by the recording material on the basis of a detection temperature by the temperature detecting element when the heat-generating block is supplied with prescribed power, and changes a control condition in the heating on the basis of the determination.

2. The image heating apparatus according to claim 1, wherein the prescribed power in the determination is such power that the ratio of power actually input in relation to maximum power that can be input to each of the heat-generating blocks is equal among the heat-generating blocks.

3. The image heating apparatus according to claim 1, further comprising:

an obtaining portion which obtains size information about the recording material, wherein the controller determines whether there is an offset in a transport position in the direction orthogonal to the transport direction for the recording material on the basis of the determination and the size information about the recording material obtained by the obtaining portion, and changes the control condition when there is the offset.

4. The image heating apparatus according to claim 3, wherein the controller sets a control target temperature for a heat-generating block which is originally not passed by the recording material but is determined to be a heat-generating block passed by the recording material because of the offset generation to a temperature lower than a control target temperature for a heat-generating block which is not passed by the recording material.

5. The image heating apparatus according to claim 1, wherein the controller controls power to be supplied to a reference heat-generating block which is the closest to a transport reference position for the recording material among the plurality of heat-generating blocks such that the detection temperature of the reference heat-generating block is maintained at a prescribed control target temperature, supplies power to the heat-generating blocks other than the reference heat-generating block in the same ratio as the ratio of actually input power in relation to the maximum power which can be input in power supplied to the reference heat-generating block, and performs the determination on the basis of the detection temperature of the heat-generating blocks other than the reference heat-generating block.

6. The image heating apparatus according to claim 1, wherein the control condition is a control target temperature for each of the heat-generating blocks.

7. The image heating apparatus according to claim 1, wherein the controller performs the determination in heating of the image formed on a first sheet of the recording material among the plurality of sheets of the recording material, and controls power to be supplied to each of the heat-generating blocks such that the detection temperature of each of the heat-generating block is maintained at a control target temperature set on the basis of the determination in heating an image formed on a second sheet and thereafter of the plurality of sheets of the recording material.

8. The image heating apparatus according to claim 1, wherein the plurality of heat-generating blocks are divided corresponding to a plurality of sizes of the recording material, and wherein the temperature detecting element is arranged in a position close to a transport reference position for the recording material in each of the heat-generating blocks.

9. The image heating apparatus according to claim 1, further comprising:

a tubular film having an inner surface in contact with the heating unit; and a pressing member which contacts an outer surface of the film and forms a nip portion for transporting the recording material between the outer surface and the pressing member, wherein the heater has a substrate and wherein each of the plurality of divided heat-generating blocks includes a heat generating resistor provided on the substrate.

10. An image heating apparatus comprising:

a heating unit which includes a heater for heating an image formed on a recording material and has a plurality of divided heat-generating blocks in a direction orthogonal to a transport direction for the recording material;

a temperature detecting element which detects a temperature of each of the heat-generating blocks; and a controller which controls power to be supplied to each of the heat-generating blocks, wherein, when the image heating apparatus continuously heats images formed on a plurality of sheets of the recording material having an equal size, the controller determines whether each of the heat-generating blocks is a heat-generating block which is passed by the recording material or a heat-generating block which is not passed by the recording material on the basis of the level of the power supplied to the heat-generating block when the power to be supplied to the heat-generating block is controlled such that the detection temperature by the temperature detecting element is maintained at a prescribed control target temperature, and changes a control condition in the heating on the basis of the determination.

11. The image heating apparatus according to claim 10, further comprising:

an obtaining portion which obtains size information about the recording material, wherein in the determination, the controller compares the levels of power supplied to a pair of heat-generating blocks in a symmetric position with respect to a transport reference position of the recording material on the basis of the size information about the recording material obtained by the obtaining portion, determines whether there is an offset in a transport position in the direction orthogonal to the transport direction for the recording material, and changes the control condition when there is the offset.

12. An image forming apparatus comprising:

an image forming portion which forms an image on a recording material;

a fixing portion which fixes the image formed on the recording material, on the recording material; and a controller, the fixing portion including:

a heating unit which includes a heater for heating an image formed on the recording material and has a plurality of divided heat-generating blocks in a direction orthogonal to a transport direction for the recording material; and a temperature detecting element which detects a temperature of each of the heat-generating blocks, wherein the controller controls power to be supplied to each of the heat-generating blocks, wherein, when the fixing portion continuously heats images formed on a plurality of sheets of the recording material having an equal size, the controller determines whether each of the heat-generating blocks is a heat-generating block which is passed by the recording material or a heat-generating block which is not passed by the recording material on the basis of the level of power supplied to each of the heat-generating block when the power supplied to each of the heat-generating block is controlled such that the detection temperature by the temperature detecting element is maintained at a prescribed control target temperature, and changes a control condition in the heating on the basis of the determination.

* * * * *